US005709983A

United States Patent [19]

Brick et al.

[11] Patent Number: 5,709,983

[45] Date of Patent: Jan. 20, 1998

[54] NONAQUEOUS SOLID PARTICLE DYE DISPERSIONS

[75] Inventors: Mary Christine Brick, Webster; Thomas Michael Smith, Spencerport; Ronda Ellen Factor; Eugene Arthur Armour, both of Rochester; Wayne Arthur Bowman, Walworth, all of N.Y.

[73] Assignee: Eastman Kodak Company, Rochester, N.Y.

[21] Appl. No.: 698,413

[22] Filed: Aug. 15, 1996

Related U.S. Application Data

[60] Provisional application No. 60/003,096 Aug. 31, 1995.

[51] Int. Cl.[6] ..... G03C 1/83

[52] U.S. Cl. ..... 430/519; 430/517; 430/520; 430/521; 430/522; 430/631

[58] Field of Search ..... 430/517, 522, 430/631, 519, 520, 521

[56] References Cited

U.S. PATENT DOCUMENTS

| | | | |
|---|---|---|---|
| 3,030,370 | 4/1962 | Jackson | 260/279 |
| 3,676,147 | 7/1972 | Boyer et al. | 96/130 |
| 3,764,327 | 10/1973 | Nagae et al. | 430/373 |
| 4,092,168 | 5/1978 | Lemahieu et al. | 96/84 R |
| 4,420,555 | 12/1983 | Krueger et al. | 430/507 |
| 4,522,654 | 6/1985 | Chisvette et al. | 106/288 Q |
| 4,523,923 | 6/1985 | Büchel et al. | 8/524 |
| 4,740,370 | 4/1988 | Faryniarz et al. | 424/61 |
| 4,770,984 | 9/1988 | Ailliet et al. | 430/505 |
| 4,900,653 | 2/1990 | Factor et al. | 430/522 |
| 4,914,011 | 4/1990 | Grous | 430/422 |
| 4,940,654 | 7/1990 | Diehl et al. | 430/522 |
| 5,278,037 | 1/1994 | Karino | 430/513 |
| 5,281,513 | 1/1994 | Goto et al. | 430/512 |
| 5,360,702 | 11/1994 | Zengerle et al. | 430/505 |

FOREIGN PATENT DOCUMENTS

| | | |
|---|---|---|
| 064861 | 11/1982 | European Pat. Off. . |
| 456163 | 11/1991 | European Pat. Off. . |
| 577138 | 1/1994 | European Pat. Off. . |
| 587229 | 3/1994 | European Pat. Off. . |
| 594973 | 5/1994 | European Pat. Off. . |
| 2164249 | 7/1972 | Germany . |

*Primary Examiner*—Richard L. Schilling
*Attorney, Agent, or Firm*—Andrew J. Anderson

[57] ABSTRACT

Photographic elements are formed by (a) coating a first layer on a transparent support from a coating composition comprising an organic solvent, an alkaline aqueous insoluble, organic solvent soluble film forming binder, and a solid particle non-aqueous dispersion of a filter dye which is substantially insoluble in the organic solvent and readily soluble or decolorizable in alkaline aqueous photographic processing solutions at pH of 8 or above, and (b) coating a second layer on the opposite side of the support relative to the filter dye containing layer from an aqueous coating composition comprising a silver halide emulsion. The solid particle dispersions of photographic filter dyes which are readily soluble or decolorizable in alkali aqueous photographic processing solutions at pH of 8 or above, are prepared by milling the dye in the presence of a non-aqueous liquid in which the dye is substantially insoluble to obtain a solid particle dispersion consisting of fine particles of dye dispersed in a non-aqueous medium. The present invention provides a method to incorporate filter dyes with desired absorbance characteristics for imaging elements, in coating processes that cannot tolerate significant quantities of water.

24 Claims, 7 Drawing Sheets

NONAQUEOUS SOLID PARTICLE DYE DISPERSIONS

CROSS REFERENCE TO RELATED APPLICATION

Reference is made to and priority from U.S. Provisional application Ser. No. U.S. 60/003,096, filed 31 Aug. 1995, entitled NONAQUEOUS SOLID PARTICLE DYE DISPERSIONS.

FIELD OF THE INVENTION

This invention relates to solid particle filter dye dispersions and to photographic elements containing such dispersions, and in particular to a method of incorporating filter dyes in a filter or antihalation layer of a photographic element in the form of nonaqueous solid particle dispersions.

BACKGROUND OF THE INVENTION

Photographic elements typically comprise some form of antihalation protection. Halation has been a persistent problem with photographic films comprising one or more photosensitive silver halide emulsion layers coated on a transparent support. The emulsion layer diffusely transmits light, which then reflects back into the emulsion layer from the support surface. The silver halide emulsion is thereby reexposed at locations different from the original light path through the emulsion, resulting in "halos" on the film surrounding images of bright objects.

One method proposed for preventing halation in photographic films comprises using a support which contains dyes or pigments. Such approach is undesirable for negative or projection or slide print films, as the added dyes or pigments in the support would require higher intensity printing exposures for negative films and detract from the projected image of print films.

Another proposed method comprises providing a dyed or pigmented layer behind a clear support as an antihalation backing layer, wherein the backing layer is designed to be removed during processing of the film, as disclosed in, e.g., U.S. Pat. No. 4,914,011. Typical examples of such antihalation backing layers comprise a dye or pigment (such as carbon black) which functions to absorb the light dispersed in an alkali-soluble polymeric binder (such as cellulose acetate hexahydrophthalate) that renders the layer removable by an alkaline photographic processing solution. Such backing layers have been commonly used for antihalation protection in motion picture films. Such backing layers provide effective antihalation protection during exposure, however, their use requires special additional processing steps for their subsequent removal, and incomplete removal of the pigmented antihalation layer can cause image defects in the resulting print film. Additionally, such removable layers fail to provide any scratch and abrasion resistance, lubricity and antistatic protection for the processed element after their removal.

A third proposed method for antihalation protection for photographic materials comprises use of an antihalation hydrophilic colloid undercoat layer containing filter dyes or silver metal coated between the support and the emulsion layers, wherein the filter dyes or silver is solubilized and removed during processing of the film without removal of the hydrophilic colloid layer itself. Such antihalation undercoats have also been commonly used in motion picture films.

For hydrophilic colloid antihalation and filter layers coated on the same side of the support as the light sensitive emulsion layers of a photographic element, filter dyes are typically incorporated into such layers as water soluble dyes, as conventional oil-in-water dispersions, as loaded polymeric latex dispersions, or as aqueous solid particle dispersions. Filter dyes coated in such layers, however, are known to sometimes diffuse at least partially to adjacent emulsion layers, where they may sensitize the emulsion to an unwanted part of the spectrum. Mordanted filter dyes are generally less susceptible to wandering, but result in greater dye stain after photographic processing. Filter dyes and mordants may also interact undesirably with other components in the same layer or adjacent layers of the film. The incorporation of filter dyes which are relatively insoluble at aqueous coating pH's of less than 7 and readily soluble and/or decolorizable at alkali processing pH's of above 8 in the form of aqueous solid particle dispersions as disclosed in, e.g., Lemahieu et al in U.S. Pat. No. 4,092,168, Ailliet et al in U.S. Pat. No. 4,770,984, Factor et al in U.S. Pat. No. 4,900,653 and Diehl et al in U.S. Pat. No. 4,940,654, have helped minimize such dye wandering and dye stain problems.

While the incorporation of filter dyes as solid particle dispersions may help alleviate problems to a certain extent, the presence of solid particle dyes in sufficient quantities may also cause layer adhesion problems to the support. Another problem associated with solid particle dispersions of filter dyes which are relatively insoluble at aqueous coating pH's of less than 7 and readily soluble and/or decolorizable at alkali processing pH's of above 8, is their hydrophobicity at low pH coupled with the presence of ionogenic groups such as carboxyl, hydroxyl, etc., often makes it difficult to obtain stable, finely divided, solid particle dispersions of these dyes in water at high concentrations using conventional surfactants as dispersing agents. The viscosities of such dispersions tend to rise with decreasing particle size due to interparticle interaction which causes flocculation, and it has been found that the protection of conventional surfactants and polymers against such flocculation in an aqueous medium is often insufficient for obtaining stable aqueous solid particle dispersions of these dyes in concentrations higher than about 5 weight percent.

It may be desirable to coat filter dyes on the opposite side of the support as the aqueous coated emulsion layers. For hydrophilic colloid antihalation or filter layers coated on the side of the transparent support opposite to that carrying the emulsion layers (where the layer is not alkali soluble itself), water soluble filter dyes are usually coated from an aqueous coating solution. Such dyes are readily removed during processing of the photographic element with aqueous processing solutions, and the presence of the support prevents such dyes from diffusing into the photographic element emulsion layers prior to processing and causing the above noted problems.

The use of water soluble filter dyes in a backing layer solves several problems related with the use of dyes or pigments (such as carbon black) in an alkali soluble, process removable binder as discussed above, as antihalation and filter layers having alkali soluble binders have the disadvantage of creating dust that can smear the photographic elements, and they are cumbersome to remove before development of the film. However, coating a layer on the backside of a photographic element often requires the use of an organic solvent due to various constraints. These may include coating on or over water-sensitive layers or supports, coating at high speeds with limited drying capabilities, coating of water insoluble film forming binders, and coating where the presence of substantial amounts of water will impede efficient recovery of organic solvents used elsewhere in the manufacturing process.

Accordingly, it would be desirable to incorporate filter dyes which effectively provide filter or antihalation protection in an organic solvent coated layer, which itself is not removed during photographic processing, on the backside of a photographic element, where such dyes are solubilized and removed or at least decolorized during processing with an alkaline photographic processing solution.

SUMMARY OF THE INVENTION

An objective of this invention is to provide a process to incorporate filter dyes in a nonaqueous medium so that they can be used in preparing an organic solvent coated layer of a photographic imaging element. Another object of this invention is to prepare nonaqueous, fine solid particle dispersions of dyes at relatively high concentrations, e.g., above 5 weight % dye, without adverse effects on the rheology of the dispersion and colloidal stability. Another object of this invention is to provide a photographic film element containing such dyes in a permanent layer on the back of the film support, which dyes are readily removed or decolorized during photographic processing of the photographic element, such that the film support also provides the properties of abrasion resistance, lubricity and antistatic protection, which properties are also retained after photographic processing. These and other objects are achieved in accordance with the invention, wherein a process is disclosed for preparing a solid particle dispersion of a filter dye in a nonaqueous liquid medium in which the dye is substantially insoluble.

In accordance with one embodiment of the invention, a process is disclosed for forming a photographic element comprising (a) coating a first layer on a transparent support from a coating composition comprising an organic solvent, an alkaline aqueous insoluble, organic solvent soluble film forming binder, and a solid particle non-aqueous dispersion of a filter dye which is substantially insoluble in the organic solvent and readily soluble or decolorizable in alkaline aqueous photographic processing solutions at pH of 8 or above, and (b) coating a second layer on the opposite side of the support relative to the filter dye containing layer from an aqueous coating composition comprising a silver halide emulsion.

In accordance with another embodiment of the invention, a photographic element is disclosed comprising an organic solvent coated first layer on one side of a transparent support, said first layer comprising a non-aqueous solid particle dispersion of a filter dye which is readily soluble or decolorizable in alkali aqueous photographic processing solutions at pH of 8 or above dispersed in an alkaline aqueous insoluble, organic solvent soluble film forming binder, and an aqueous coated second layer comprising a silver halide emulsion on the opposite side of the support relative to the filter dye containing layer.

In accordance with a further embodiment of the invention, a process is disclosed of preparing solid particle dispersions of photographic filter dyes which are readily soluble or decolorizable in alkali aqueous photographic processing solutions at pH of 8 or above, comprising milling the dye in the presence of a non-aqueous liquid in which the dye is substantially insoluble to obtain a solid particle dispersion consisting of fine particles of dye dispersed in a non-aqueous medium.

ADVANTAGES OVER PRIOR ART

The present invention provides a method to incorporate filter dyes with the desired absorbance characteristics for imaging elements, in coating processes that cannot tolerate significant quantities of water. Filter dyes previously disclosed for use in the form of solid particle dispersions typically have low solubility in water and organic solvents due to their highly crystalline nature, and therefore cannot be dissolved at sufficiently high concentrations in organic liquids to provide adequate antihalation protection. The filter dyes are decolorized or removed upon processing, and may be incorporated on the back of a photographic film support with a binder and a lubricant, either in the same layer or separate layer, over a protected antistatic layer. Preprocessing physical properties of antihalation protection, abrasion resistance, lubricity and antistatic properties can be obtained which are equal to or superior to the prior art of removable backing layers containing carbon, while the properties of abrasion resistance, lubricity and antistatic protection are also advantageously retained after processing, unlike films that contain carbon on the back of the support. This is especially desirable for motion picture film materials, which are subject to continued rapid transport processes even after photographic processing. This invention also has the advantage that fine particle, nonaqueous dispersions can be prepared with dyes at relatively high concentrations without adverse effects on the rheology of the dispersion and colloidal stability.

DETAILED DESCRIPTION OF THE INVENTION

Figure 1:
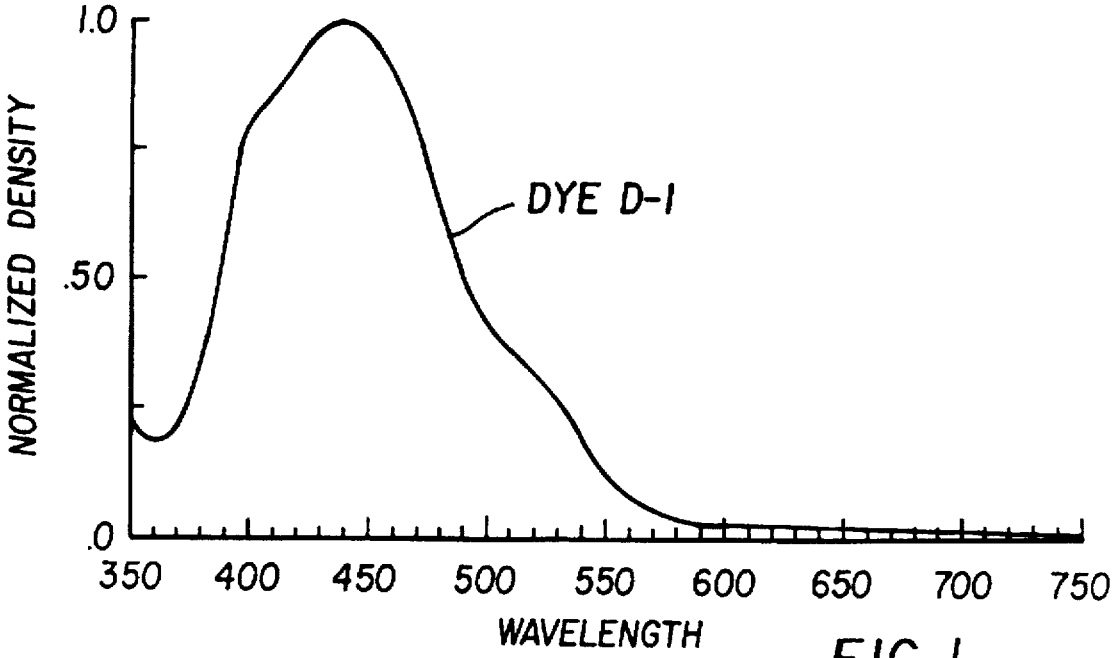
FIGS. 1–13 depict absorption spectra of non-aqueous solid particle dye dispersions coated in accordance with the invention, as further explained in the Examples set forth below.
Figure 2:
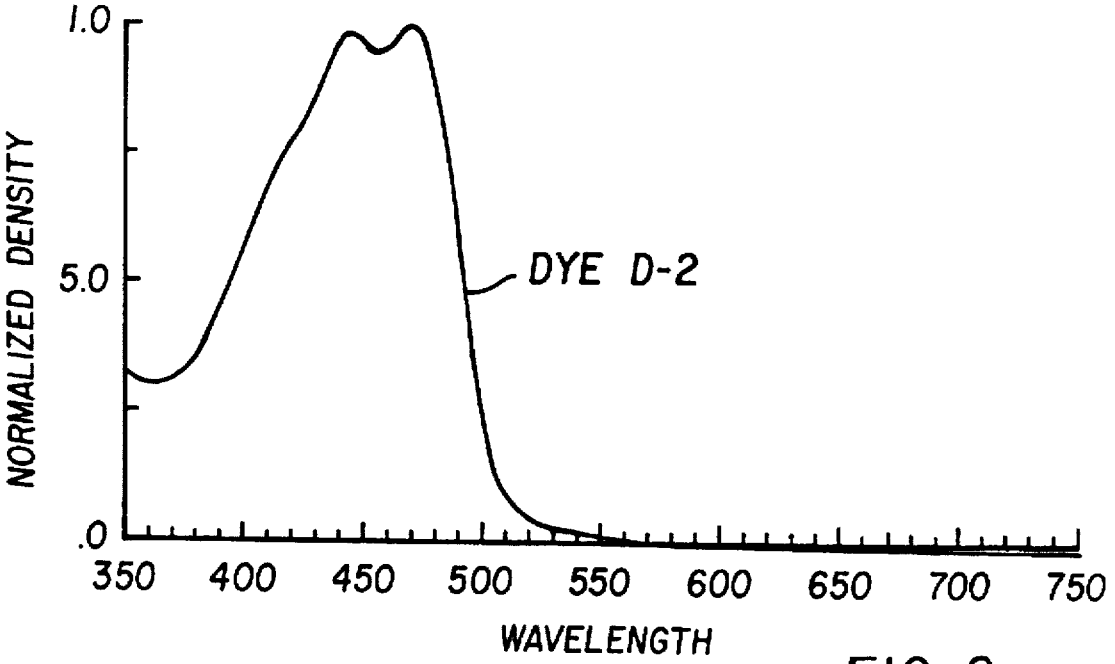
Figure 3:
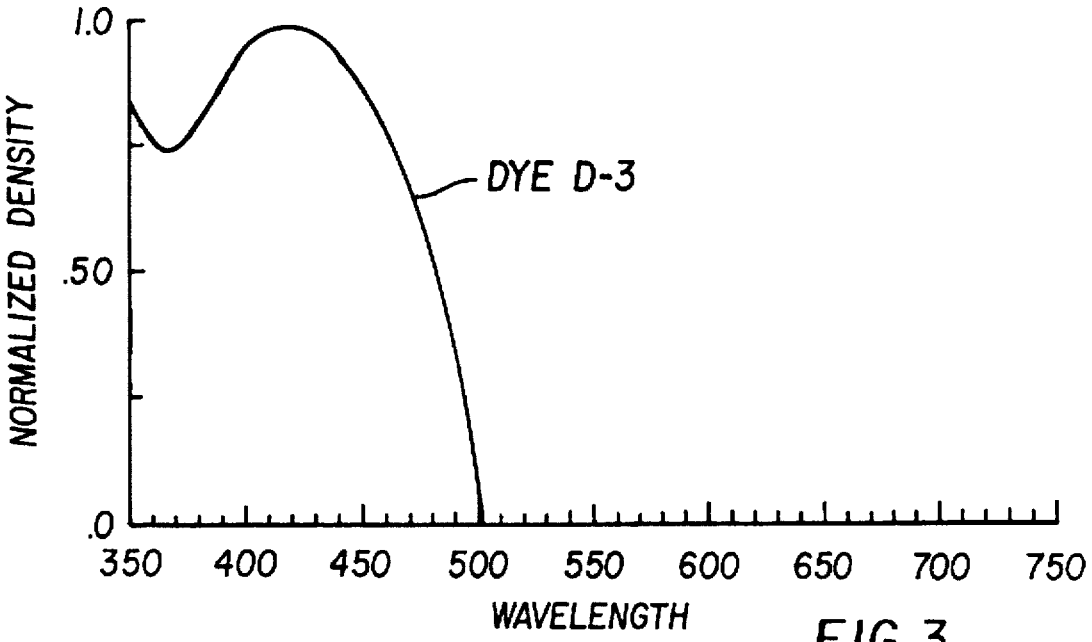
Figure 4:
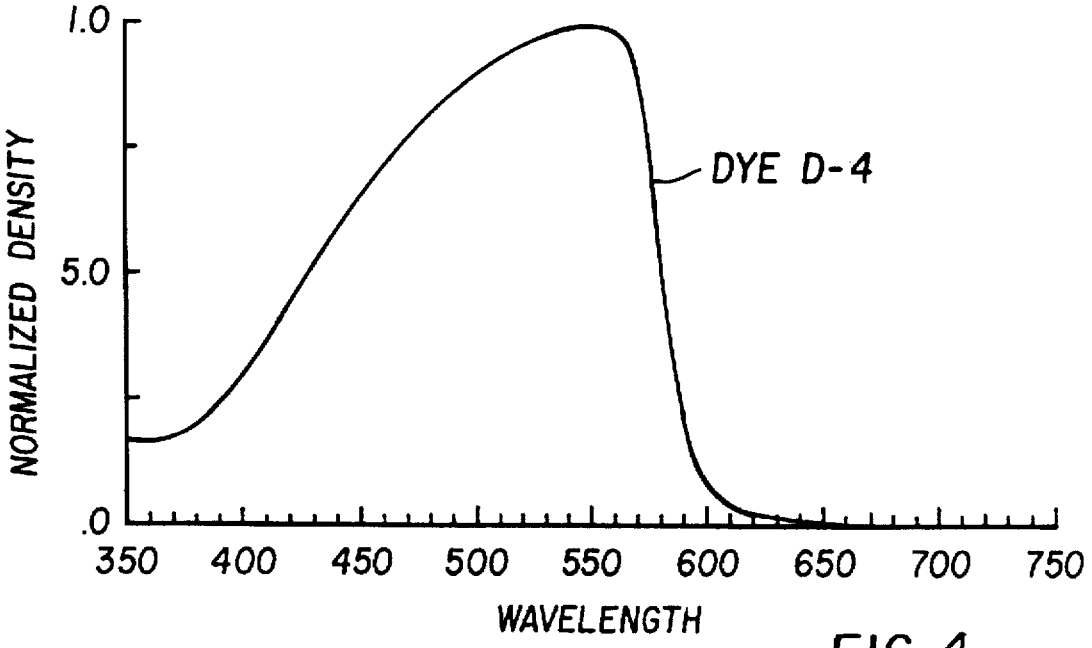
Figure 5:
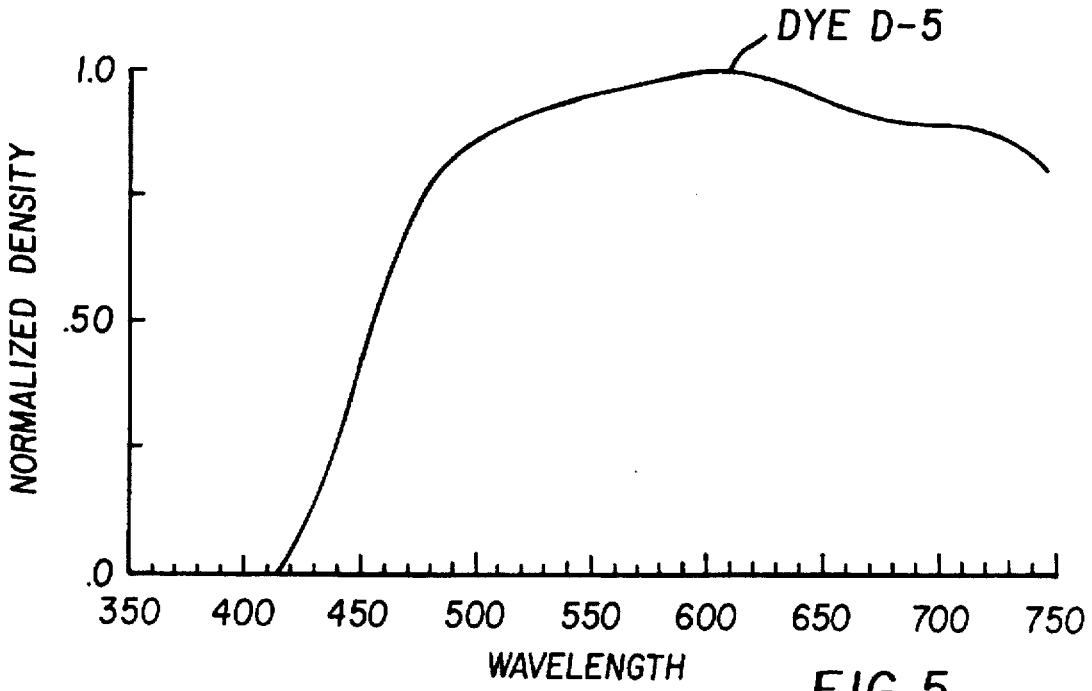
Figure 6:
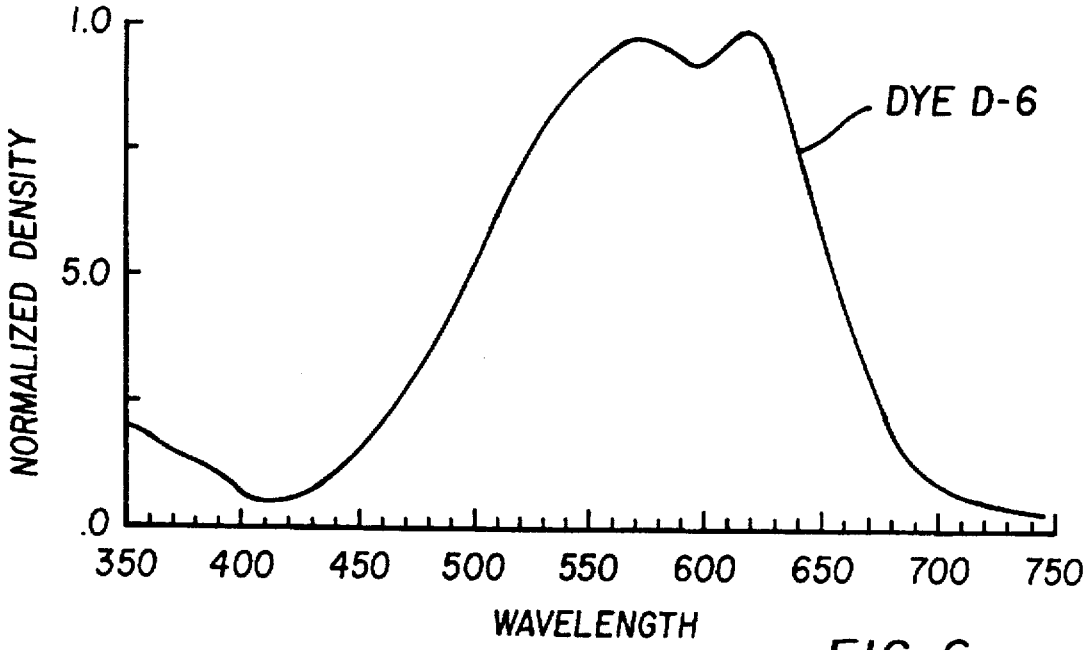
Figure 7:
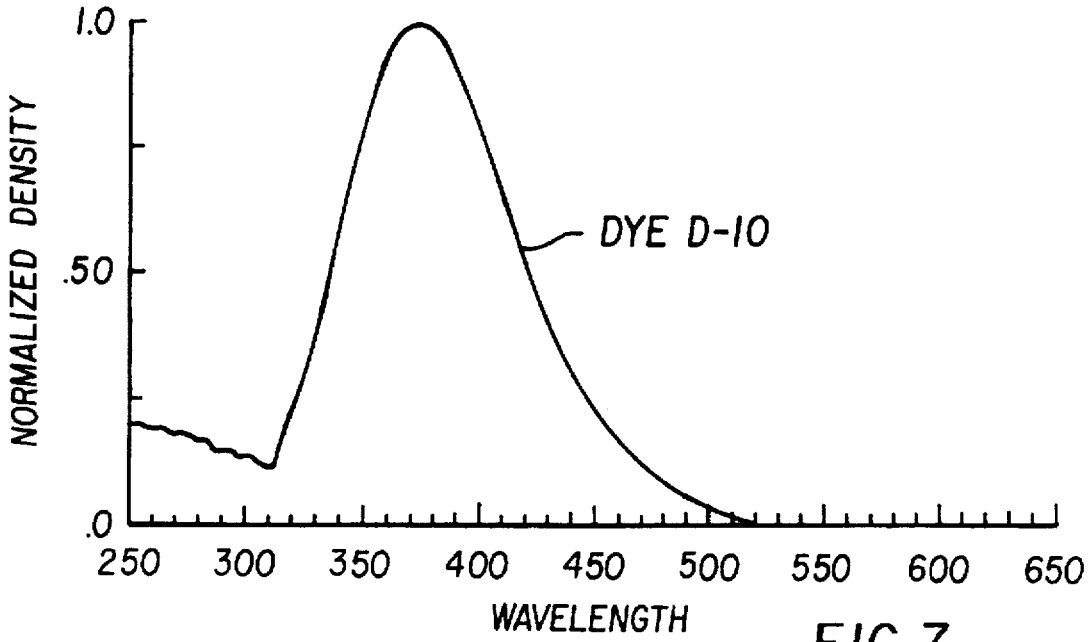
Figure 8:
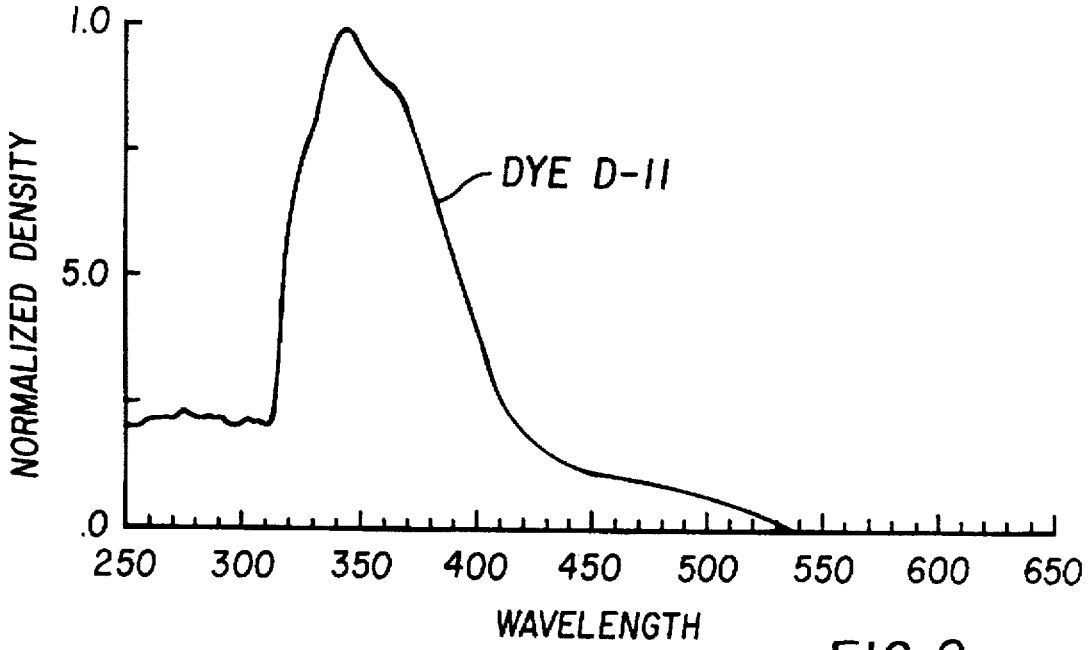
Figure 9:
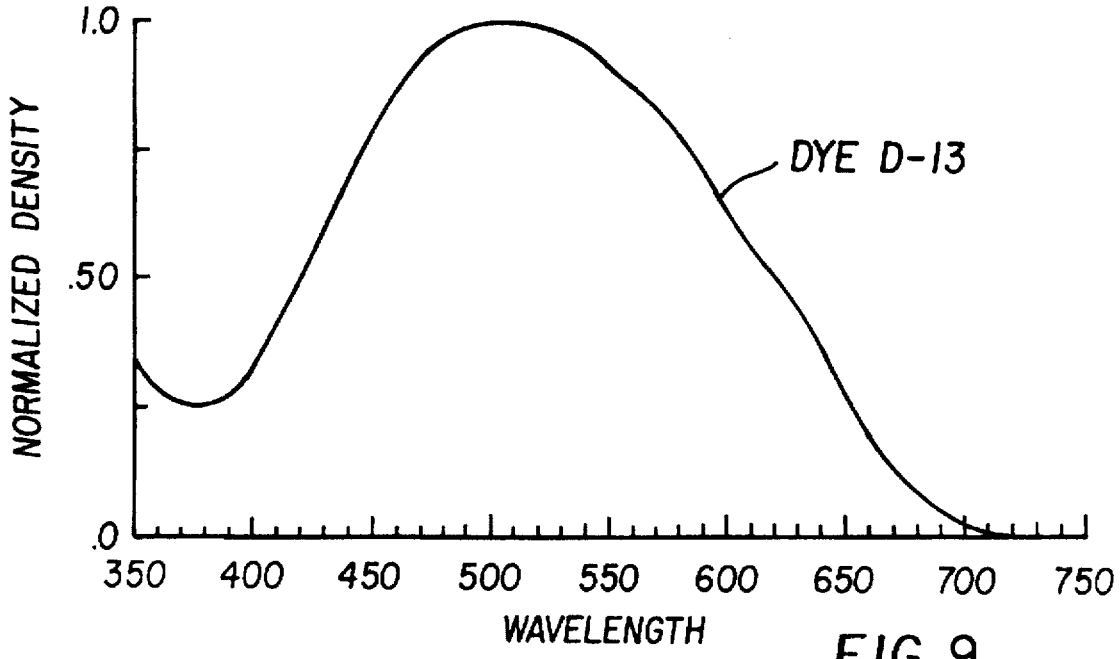
Figure 10:
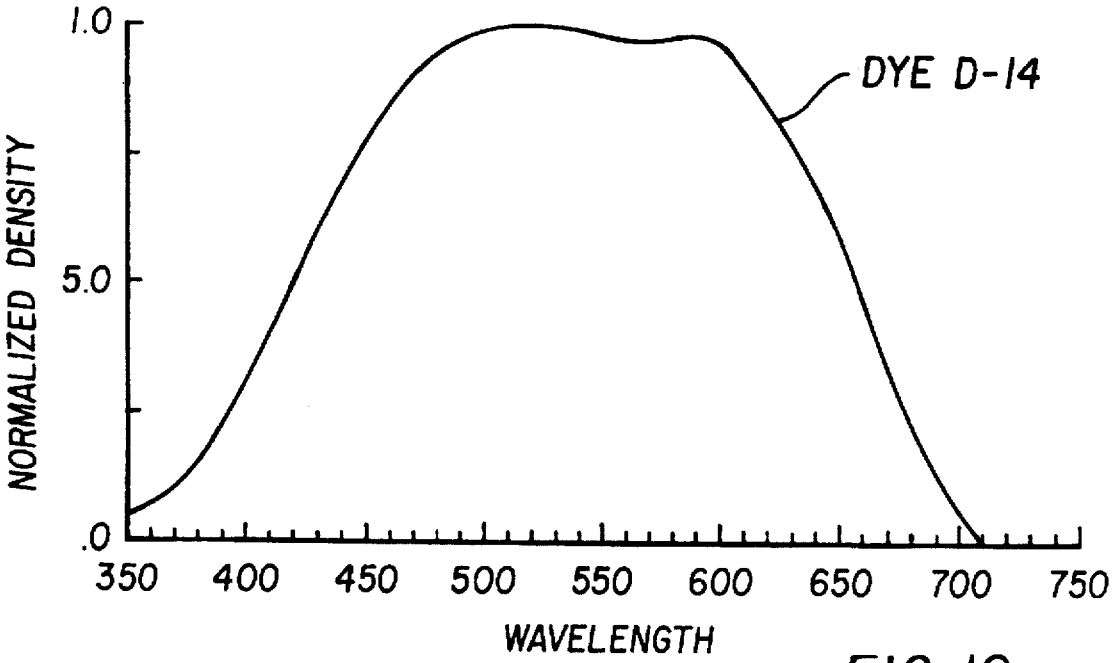
Figure 11:
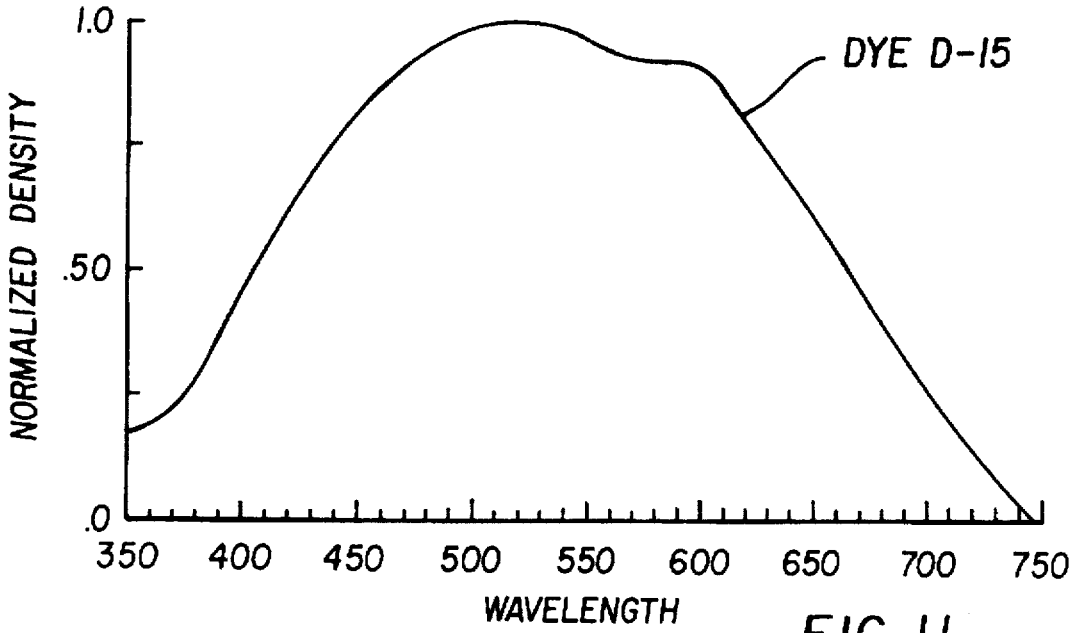
Figure 12:
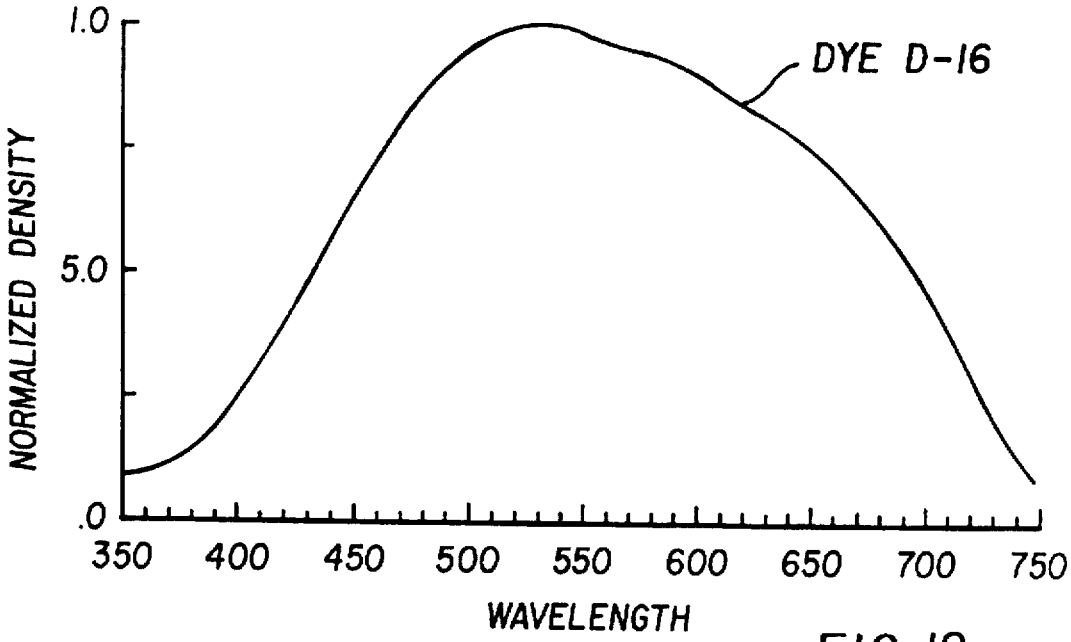

Filter dyes that can be used in accordance with this invention are those which are substantially insoluble in an organic solvent coating composition, and readily soluble or decolorizable in alkali aqueous photographic processing solutions at pH of 8 or above, so as to be removed from or decolorized in a photographic element upon photographic processing. By substantially insoluble is meant dyes having a solubility of less than 1% by weight in solution, preferably less than 0.1% by weight. Such dyes are generally of the formula (i):

$$D-(X)_n \qquad (I)$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton may be, e.g., a carboxyl group, a sulfonamido group, a sulfamoyl group, a sulfonylcarbamoyl group, a carbonylsulfamoyl group, a hydroxy group, and the enol group of a oxanol dye. Such general class of ionizable filter dyes represented by formula (I) is well known in the photographic art, and includes, e.g., dyes disclosed for use in the form of aqueous solid particle dye dispersions as described in International Patent Publication WO 88/04794, European patent applications EP 594 973, EP 549 089, EP 546 163 and EP 430 180; U.S. Pat. Nos. 4,803,150, 4,855,221, 4,857,446, 4,900,652, 4,900,653, 4,940,654, 4,948,717, 4,948,718, 4,950,586, 4,988,611, 4,994,356, 5,098,820, 5,213,956, 5,260,179, and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

Preferred dyes of formula I include those of formula (II):

$$[D—(A)_y]—X_n \quad (II)$$

where D, X and n are as defined above, and A is an aromatic ring bonded directly or indirectly to D, y is 0 to 4, and X is bonded either on A or an aromatic ring portion of D.

Exemplary dyes in accordance with the invention include those in Tables I to X of WO 88/04794, formulas (I) to (VII) of EP 0 456 163 A2, formula (II) of EP 0 594 973, and Tables I to XVI of U.S. Pat. No. 4,940,654 incorporated by reference above. Preferred filter dyes useful in imaging that can be used in accordance with this invention are illustrated below. It is understood that this list is representative only, and not meant to be exclusive.

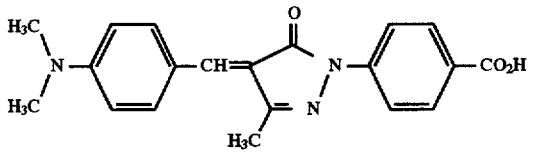

Dye D-1

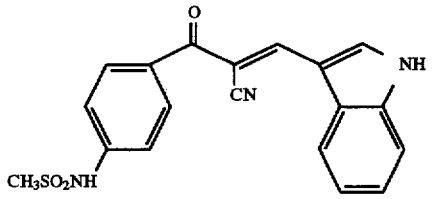

Dye D-2

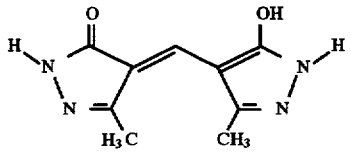

Dye D-3

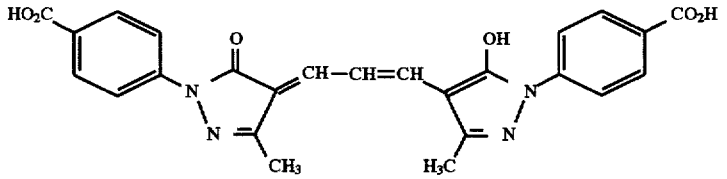

Dye D-4

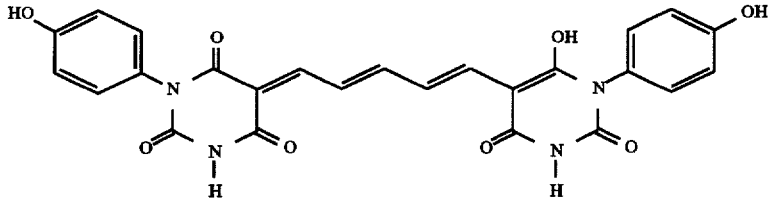

Dye D-5

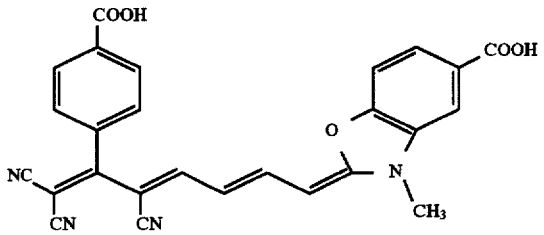

Dye D-6

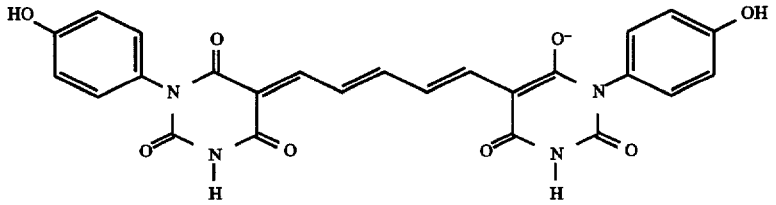

Dye D-7

-continued
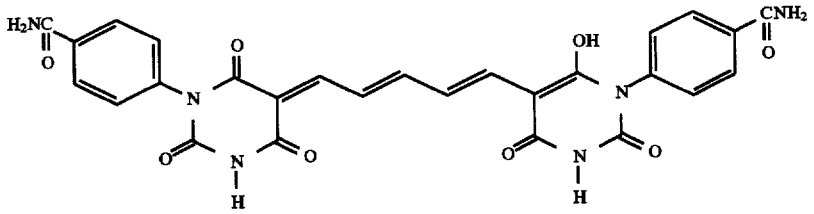
Dye D-8
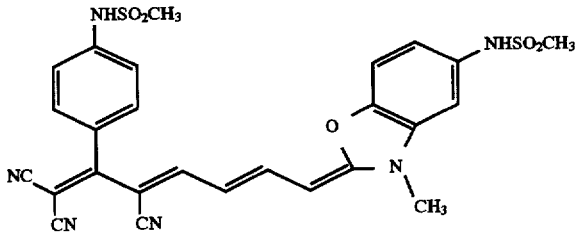
Dye D-9
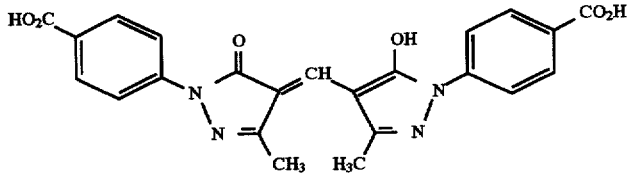
Dye D-10
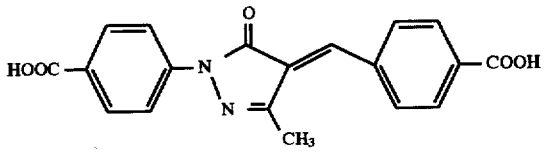
Dye D-11
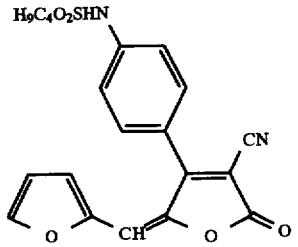
Dye D-12
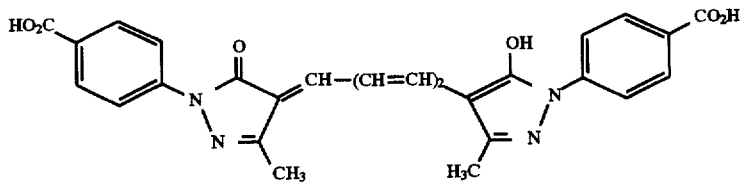
Dye D-13
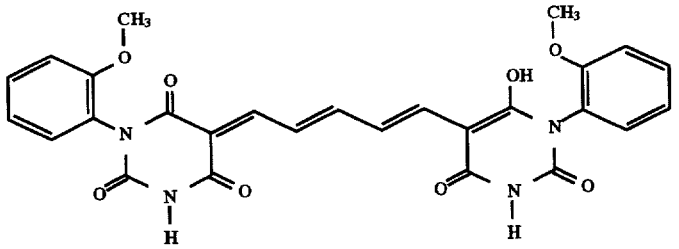
Dye D-14

-continued

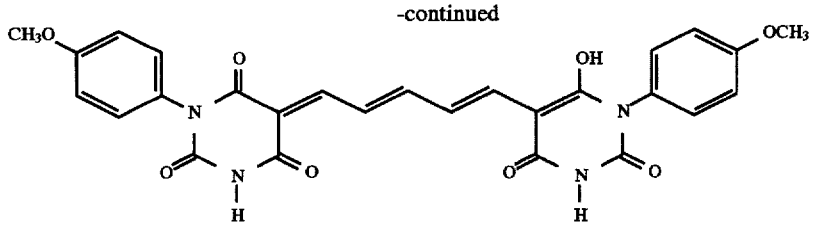

Dye D-15

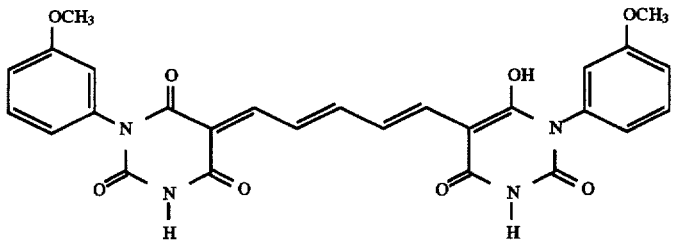

Dye D-16

In a preferred embodiment of the invention, D represents a pentamethine oxonol-type barbituric acid dye residue, such as dyes D-5, D-7, D-8, D-14, D-15, and D-16 illustrated above, as these dyes have been found to exhibit absorption spectrums in the form of non-aqueous solid particle dispersions which are particularly advantageous for photographic element antihalation protection.

It is a further requirement of the invention that the filter dyes be substantially insoluble in a non-aqueous liquid for forming a solid particle non-aqueous dispersion. By substantially insoluble is meant dyes having a solubility of less than 1% by weight in solution, preferably less than 0.1% by weight.

The solid particle non-aqueous dispersions of this invention can be prepared by mixing together a coarse slurry of the filter dye of interest in a nonaqueous liquid, with or without a dispersing aid and a binder. The slurry is then added to a mill where repeated collisions of milling media with the solid crystals in the slurry of the filter dye result in crystal fracture and resultant particle size reduction. The length of time required to mill the particles to the desired particle size depends on the milling device used. In the dispersion form, the composition preferably contains from 5% to 80% by weight of the dye, the precise quantity depending upon the nature of the solid and liquid. The mill used to accomplish particle size reduction can be for example a colloid mill, swinging mill, ball mill, media mill, attritor mill, jet mill, vibratory mill, high pressure homogenizer, etc. These methods are described, e.g., in U.S. Pat. Nos. 4,006,025, 4,294,916, 4,294,917, 4,940,654, 4,950,586 and 4,927,744, and UK 1,570,362. The mill can be charged with the appropriate media such as, for example, sand, spheres of silica, stainless steel, silicon carbide, glass, zirconium, zirconium oxide, alumina, titanium, polymeric media such as cross-linked polystyrene beads, etc. The media sizes typically range from 0.25 to 3.0 mm in diameter, but smaller milling media, e.g. media having a mean particle size less than 100 microns, may also be used.

Generally for use in photographic imaging elements, a solid particle dispersion of this invention should have an average particle size of 0.01 to about 10 mm, preferably less than 3 mm, and more preferably, the solid particles are of a sub-micron average size. Even more preferably, the dispersed solid particles have a mean particle size of less than 0.5 micron, most preferably less than about 0.3 micron. In preferred embodiments of the invention the dispersed particles have a particle size of between 0.01 to about 1.0 micron, more preferably 0.01 to 0.5 and most preferably 0.05 to 0.3 micron. Generally, the desired particle sizes can be achieved by milling a solid particle dye slurry for 30 minutes to 31 days, preferably 60 minutes to 14 days, depending on the mill used.

The non-aqueous liquid of a solid particle filter dye dispersion of this invention may comprise any conventional organic solvent, such as a polar organic medium or a substantially non-polar aromatic hydrocarbon or halogenated hydrocarbon, in which the filter dye of the dispersion is substantially insoluble. By the term "non-aqueous liquid" is meant a liquid or liquid mixture containing less than 50 weight percent water. The non-aqueous liquid preferably contains less than 10 weight percent water, and most preferably contains less than 1 weight percent water. By the term "polar" in relation to an organic medium is meant an organic liquid or resin capable of forming moderate to strong bonds as described in the article entitled "A Three Dimensional Approach to Solubility" by Crowley et al. in *Journal of Paint Technology*, Vol. 38, p. 269, 1966. Such organic media generally have a hydrogen bonding number of 5 or more as defined in the above mentioned article. While various dyes may have varying degrees of solubility in different non-aqueous liquids, the selection of an appropriate non-aqueous liquid in which to form the non-aqueous solid particle dispersions of the invention for a particular dye will be readily determinable by the artisan.

Examples of suitable polar organic liquids are amines, ethers, organic acids, esters, ketones, glycols, alcohols and amides. Numerous specific examples of such moderately and strongly hydrogen bonding liquids are given in the book entitled *Compatibility and Solubility* by I. Mellan, Table 2.14 on pp 39–40, 1968, and these liquids all fall within the scope of the term polar organic liquid as used in this specification. Preferred polar organic liquids are dialkyl ketones, alkyl esters of alkane carboxylic acids and alcohols, especially such liquids containing up to, and including, a total of 6 carbon atoms. Examples of such liquids are dialkyl and cycloalkyl ketones such as acetone, methyl-ethylketone, di-ethylketone, di-iso-propylketone, methyl-iso-butylketone, di-iso-butylketone, methyl-iso-amylketone, methyl-n-amylketone and cyclohexanone; alkyl esters such as methyl acetate, ethyl acetate, propyl acetate, isopropyl acetate, butyl acetate, methyl acetoacetate, ethyl formate, methyl propionate and ethyl butyrate, glycols and glycol esters and ethers, such as ethylene glycol, 2-ethoxyethanol, 3-methoxypropylpropanol, 3-ethoxypropylpropanol, 2-butoxyethyl acetate, 3-methoxypropyl acetate, 3-ethoxypropyl acetate and 2-ethoxyethyl acetate, alcohols such as methanol, ethanol, n-propanol, isopropanol, n-butanol and isobutanol and dialkyl and cyclic ethers such as diethylether and tetrahyrofuran.

Examples of substantially non-polar organic liquids which may be used, either alone or in a mixture with the aforementioned polar solvents, include aromatic hydrocarbons, such as toluene and xylene, halogenated aliphatic and aromatic hydrocarbons, such as trichloroethylene, percholorethylene, methylene chloride, and chlorobenzene.

Preferred organic liquids for use in the nonaqueous solid particle dispersions of the invention include those commonly used in manufacture of photographic elements, such as ethyl acetate, propyl acetate, methanol, ethanol, butanol, n-propanol, methyl acetoacetate, and acetone.

In a preferred embodiment of the invention, a dispersant is present in the solid particle dispersions, preferably in the range of 1 to about 100%, more preferably about 5 to 75%, the percentage being by weight, based on the weight of the dye. The dispersant can be nonionic, such as: fatty alcohols, fatty acids, fatty esters, glycerol esters, diols, polyethoxylated diols, alkyl phenols, acetylinic glycols, alkanolamines and alkanolamides, polyethoxylated mercaptans, sorbitol and sorbitan derivatives, and nonionic block, graft, and comb copolymers; cationic, such as: polyester/polyamine copolymers, alkylamines, quaternary amines, imidazolines, dialkylamine oxides, polyester amines; anionic, such as salts of fatty acids, salts of multiple acids, sarcosine derivatives, salts of tall oil acids, sodium alkyl sulfonates, alpha-olefin sulfonates, alkylbenzene sulfonates, aromatic sulfonates, isothionates, sulfosuccinates, taurates, alcohol sulfates, alkyl phenol sulfates, sulfated triglycerides, alcohol phosphates; zwitterionic, such as: amino acids, imino acids, betaines, imidazolines, phospholipids; polymers such as: polyvinylpyrrolidones, polysaccharides, lignin derivatives, protein-based surfactants, polyacrylates, condensed naphthalene sulfonates, ethylene/acrylic acid copolymers, polesters, vinylbenzyl/methacrylate copolymers, polyethoxy/polypropoxy alcohol copolymers, and acrylic acid/isocyanate copolymers, as shown in the book *Dispersing Powders in Liquids* by R. D. Nelson, pp. 88–105, 1988, and the book entitled *Dispersions of Powders in Liquids* by G. D. Parfitt, Ed., pp. 177–191, 1986, incorporated herein by reference. Suitable materials useful in accordance with this invention are also described in U.S. Pat. No. 4,861,380 to Campell et al., U.S. Pat. No. 4,042,413 to Hauxwell et al., U.S. Pat. No. 4,156,616 to Dietz et al., and U.S. Pat. No. 4,019,923 to Mahe, incorporated herein by reference. Preferred materials include polyester amines sold by Zeneca, Inc. under the trade name designations Solsperse 24000 and Solsperse 20000 and by ICI Americas, Inc. under the trade name designations Hypermer LP4, Hypermer PS2 and Hypermer PS3; polyethylene oxide-polypropylene oxide block copolymers sold by BASF, Inc. under the trade name Pluronic, Pluronic®, Tetronic and Tetronic®; ethoxylated dialcohols sold by Air Products and Chemicals, Inc. under the trade names Surfynol 104, Surfynol 420, 440, 465, 485, 504, SE, SEF, DF-110, DF-210, DF-110L, DF-120, CT111, CT121, CT131, CT136, and CT324; and polyvinylpyrrolidones. It is understood that this list is representative only, and not meant to be exclusive.

The resulting non-aqueous solid particle dispersions can be added to an organic solvent based coating composition containing a binder, for use in the preparation of a backing layer of a film support. The organic solvent may be selected, e.g., from the above referenced non-aqueous liquids.

The binder may consist of any organic solvent-soluble material which forms a substantially aqueous photographic processing solution insoluble film. The film forming binders are preferably water insoluble vinyl co-polymers derived from any copolymerizable monomers, such as α,β-ethylenically unsaturated monomer (including two, three, or more repeating units) such as ethylene, propylene, 1-butene, isobutene, 2-methylpentene, 2-methylbutene, 1,1,4,4-tetramethylbutadiene, styrene, α-methylstyrene; monoethylenically unsaturated esters of aliphatic acids such as vinyl acetate, isopropenyl acetate, allyl acetate, etc.; esters of ethyleneically unsaturated mono- or dicarboxylic acids such as methyl methacrylate, ethyl acrylate, diethyl methylenemalonate, etc.; monoethylenically unsaturated compounds such as acrylonitrile, allyl cyanide, and dienes such as butadiene and isoprene. The particular monomer units and their proportions may be selected to achieve a desired glass transition temperature for the resulting polymer as is well known in the art. For effective abrasion resistance, the film forming polymer binders preferably have a glass transition temperature of about 20° C. or higher, more preferably about 40° C. or higher.

The organic solvent soluble polymeric film forming binders may also comprise a percentage of hydrophilic monomers (such as acrylic acids and acrylamides) to allow swelling of the backing layer to facilitate bleaching of the filter dyes, to the extent such hydrophilic monomers do not cause such binders to become readily soluble in alkaline processing solutions. The percentages of hydrophobic and relatively hydrophilic monomers may be selected by the artisan to obtain the desired degree of hardness and aqueous swellability, as long as the film remains photographic process surviving. It is an unexpected advantage of the invention, however, that nonaqueous solid particle dye dispersions were found to be readily removed or decolorized upon photographic processing even from coatings formed from essentially completely hydrophobic polymeric binders such as poly(methyl methacrylate). In one preferred embodiment of the invention, the backing layer film is a relatively hard, abrasion-resistant film, which properties are enhanced by the use of relatively hydrophobic binders.

Organic solvent soluble film forming binders which may be used in combination with the solid particle dye dispersion of the invention include, for example, vinyl chloride-vinyl acetate copolymers, vinyl chloride-vinyl acetate-vinyl alcohol copolymers, vinyl chloride-vinyl acetate-maleic acid polymers, vinyl chloride-vinylidene chloride copolymers, vinyl chloride-acrylonitrile copolymers, acrylic ester-acrylonitrile copolymers, acrylic ester-vinylidene chloride copolymers, methacrylic ester-vinylidene chloride copolymers, methacrylic ester-styrene copolymers, methacrylate homopolymers and copolymers, thermoplastic polyurethane resins, phenoxy resins, polyvinyl fluoride, vinylidene, chloride-acrylonitrile copolymers, butadiene-acrylonitrile copolymers, acrylonitrile-butadiene-acrylic acid copolymers, acrylonitrile-butadiene-methacrylic acid copolymers, polyvinyl butyral, polyvinyl acetal, cellulose derivatives such as cellulose nitrate, cellulose acetate, cellulose diacetate, cellulose triacetate, cellulose acetate butyrate, and cellulose acetate propionate, styrene-butadiene copolymers, polyester resins, phenolic resins, epoxy resins, thermosetting polyurethane resins, urea resins, melamine resins, alkyl resins, urea-formaldehyde resins and the like.

Acrylic ester homopolymers and copolymers are preferred binders in accordance with this invention. Preferred binders include, e.g., polymers composed of 40–100 weight percent of an acrylic ester such as ethyl acrylate, methyl acrylate, propyl acrylate, ethyl methacrylate, propyl methacrylate, or butyl methacrylate, 0–30 weight percent of an acid such as acrylic acid, methacrylic acid, or itaconic acid, and 0–30 weight percent of an acrylamide such as N,N-dimethyl acrylamide, i-propyl acrylamide, t-butyl acrylamide, i-propyl methacrylamide, or t-butyl methacrylamide. Particularly preferred binders include methacrylate homopolymers, and polymers of about 50 weight percent ethyl acrylate, 25 weight percent acrylic acid, and 25 weight percent N,N-dimethyl acrylamide.

The film forming binders may include cross-linkable monomers, and the binders may be cross-linked using conventional cross-linking agents to improve abrasion resistance. For crosslinking of the binder with isocyanates, e.g., the binder should contain active hydrogen atoms, such active hydrocarbon atoms including —OH, —$NH_2$, —NHR, where R is an organic radical, and the like, as described in U.S. Pat. No. 3,479,310. Other conventional cross-linking agents may also be used.

Any suitable photographic film support may be employed in the practice of this invention, such as, cellulose derivatives including cellulose diacetate, cellulose triacetate, cellulose propionate, cellulose butyrate, cellulose acetopropionate and the like; polyamides; polycarbonates; polyesters, particularly polyethylene terephthalate, poly-1,4-cyclohexanedimethylene terephthalate, polyethylene 1,2-diphenoxyethane-4,4'-dicarboxylate, polybutylene terephthalate and polyethylene naphthalate; polystyrene, polypropylene, polyethylene, polymethylpentene, polysulfone, polyethersulfone, polyarylates, polyether imides and the like. Particularly preferred supports are polyethylene terephthalate, polyethylene naphthalate and the cellulose esters particularly cellulose triacetate. Depending on the nature of the support, suitable transparent tie or undercoat layers may be desired. Particularly with regard to polyester supports, primers are used in order to promote adhesion of coated layers. Any suitable primers in accordance with those described in the following U.S. patents, e.g., may be employed: U.S. Pat. Nos. 2,627,088; 3,501,301; 4,689,359; 4,363,872; and 4,098,952. The disclosures of each of these patents are incorporated herein by reference in their entirety.

The support of the imaging elements of this invention can be coated with a magnetic recording layer as discussed in Research Disclosure, Item 34390, of November 1992, the disclosure of which is herein incorporated by reference. Magnetic materials as described in Research Disclosure, Item 34390 may also be coated in a single layer with the non-aqueous dispersions of the invention. In addition, various dyes may be formulated into the support or the magnetic layer to give neutral density if desired.

Generally, photographic elements in accordance with the invention are prepared by coating a support film on the side opposite the solvent-coated solid particle filter dye dispersion layer with one or more photosensitive layers comprising a silver halide emulsion in an aqueous solution of gelatin and optionally one or more aqueous coated gelatin subbing, inter, or overcoat layers. The aqueous coated layers may be coated before or after the solvent-coated filter dye dispersion layer is coated, but is preferably coated after such solvent coating is performed. The coating processes can be carried out on a continuously operating machine wherein a single layer or a plurality of layers are applied to the support. For multicolor elements, layers can be coated simultaneously on the composite support film as described in U.S. Pat. Nos. 2,761,791 and 3,508,947. Additional useful coating and drying procedures are described in Research Disclosure, Vol. 176, December 1978, Item 17643. Suitable photosensitive image forming layers are those which provide color or black and white images.

The photosensitive layers can be image-forming layers containing photographic silver halides such as silver chloride, silver bromide, silver bromoiodide, silver chlorobromide, and the like. Both negative working and reversal silver halide elements are contemplated. Suitable emulsions and film formats, as well as examples of other compounds and manufacturing procedures useful in forming photographic imaging elements in accordance with the invention, can be found in Research Disclosure, September 1994, Item 36544, published by Kenneth Mason Publication, Ltd., Dudley House, 12 North Street, Emsworth, Hampshire P010 7DQ, England, and the patents and other references cited therein, the disclosures of which are incorporated herein by reference. The preparation of single and multilayer photographic elements is also described in Research Disclosure 308119 dated December 1989, the disclosure of which is incorporated herein by reference.

It is specifically contemplated that the film formats, materials and processes described in an article titled "Typical and Preferred Color Paper, Color Negative, and Color Reversal Photographic Elements and Processing," published in *Research Disclosure,* February 1995, Volume 370, the disclosure of which is incorporated herein by reference, may also be advantageously used with the non-aqueous solid particle filter dye dispersion containing backing layers of the invention.

In a preferred embodiment of the invention, the photographic elements contain one or more conducting or antistatic layers such as, e.g., layers described in Research Disclosure, Vol. 176, December 1978, Item 17643 to prevent undesirable static discharges during manufacture, exposure and processing of the photographic element. Antistatic materials conventionally used in color photographic films have been found to be satisfactory for use herewith. Such materials include, e.g., anionic and cationic polymers, electronic conducting non-ionic polymers, electrically-conductive metal-containing particles such as metal halides or metal oxides in polymer binders. Any of the antistatic agents set forth is U.S. Pat. No. 5,147,768, e.g., the disclosure of which is incorporated herein by reference, may be employed.

Exemplary antistatic materials which may be used include, e.g., anionic, cationic, or electronic conducting non-ionic polymers, and metal halides or metal oxides in polymer binders. Conductive fine particles of crystalline metal oxides dispersed with a polymeric binder have been used to prepare optically transparent, humidity insensitive, antistatic layers for various imaging applications. Many different metal oxides, such as AnO, $TiO_2$, $ZrO_2$, $Al_2O_3$, $SiO_2$, MgO, BaO, $MoO_3$, and $V_2O_5$, are disclosed as useful as antistatic agents in photographic elements or as conductive agents in electrostatographic elements in such patents as U.S. Pat. Nos. 4,275,103; 4,394,441; 4,416,963; 4,418,141; 4,431,764; 4,495,276; 4,571,361; 4,999,276; and 5,122,445, the disclosures of which are hereby incorporated by reference. Preferred metal oxides include antimony doped tin oxide, aluminum doped zinc oxide, and niobium doped titanium oxide, as these oxides have been found to provide acceptable performance characteristics in demanding environments. Particular preferred metal oxides for use in this invention are antimony-doped tin oxide, zinc antimonates, and vanadium pentoxide which provide good resistance to static discharge. Preferred polymeric antistats include polyanilines. In accordance with an advantage of the invention, the antistatic materials may be included in the permanent non-aqueous coated solid particle filter dye dispersion containing layer, or in a separate permanent layer, on the backside of the photographic element support to provide post-processing as well as pre-processing antistatic protection.

To provide protection of the antistatic layer, a protective overcoat or barrier layer may be applied thereon. The protective layer can chemically isolate the antistatic layer and also serve to provide additional scratch and abrasion resistance. The protective overcoat layers may be the same layer as the nonaqueous solid particle filter dye dispersion containing layer, or may be a separate layer, and may comprise, e.g., cellulose esters, cellulose nitrate, polyesters, acrylic and methacrylic copolymers and homopolymers, polycarbonates, polyvinyl formal polymethyl methacrylate, polysilicic acid, polyvinyl alcohol, and polyurethanes. The chemical resistance of the antistatic layer or an overcoat can be improved by incorporating a polymer cross-linking agent into the antistatic layer for those overcoats that have functionally cross-linkable groups. Cross-linking agents such as aziridines, carbodiimide, epoxys, and the like are suitable for this purpose.

Matting agents may also be included in the antistatic layer or overcoat thereon in order to improve transport properties of the elements of the invention on manufacturing, printing, processing, and projecting equipment. Such matting agents can also help prevent sticking between the front and back sides of the elements in a tightly wound roll. Matting agents may be silica, calcium carbonate, other mineral oxides, glass speres, ground polymers and high melting point waxes, and polymeric matte beads.

The photographic elements according to this invention can be provided with a lubricating layer, such as a wax layer, on, over, or within the same layer as the filter dye dispersion. Suitable lubricants include silicone oil, silicones having polar groups, fatty-acid modified silicones, fluorine-containing silicones, fluorine-containing alcohols, fluorine-containing esters, polyolefins, polyglycols, alkyl phosphates and alkali metal salts thereof, alkyl sulfates and alkali metal salts thereof, polyphenyl ethers, fluorine-containing alkyl sulfates and alkali metal salts thereof, long chain (e.g., greater than $C_{17}$) fatty amides such as stearamide, monobasic fatty acids having 10 to 24 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 22 carbon atoms (which may contain unsaturated bonds or may be branched), fatty acid esters of monoalkyl ethers of alkylene oxide polymers, fatty acid amines having 8 to 22 carbon atoms and aliphatic amines having 8 to 22 carbon atoms. Specific examples of these compounds (i.e., alcohols, acids or esters) include lauric acid, myristic acid, palmitic acid, stearic acid, behenic acid, docosanoic acid, butyl stearate, oleic acid, linolic acid, linolenic acid, elaidic acid, octyl stearate, amyl stearate, isooctyl stearate, sodium stearate, sodium hexadecyl sulfate, octyl myristate, butoxyethyl stearate, anhydrosorbitan monostearate, anhydrosorbitan distearate, pentaerythrityl tetrastearate, batyl alcohol, oleyl alcohol and lauryl alcohol. Carnauba wax dispersed in an organic liquid such as a low molecular weight alcohol is preferred. Such dispersions are commercially available from the Daniel Products Company as SLIP-AYD SL508.

In preferred embodiments of the invention, the nonaqueous filter dye dispersion containing layer is located as the outermost layer of a photographic element. In a further preferred embodiment of the invention, a lubricating agent is incorporated into the filter dye dispersion containing layer, and an antistatic agent is coated between the filter dye dispersion layer and the support.

In accordance with the invention, the solid particle filter dyes can be essentially completely removed or decolorized from a photographic element upon photographic processing with an alkaline aqueous processing solution. The described elements can be, e.g., processed in conventional commercial photographic processes, such as the known C-41 color negative and RA-4 color print processes as described in *The British Journal of Photography Annual* of 1988, pages 191–199. Motion picture films may be processed with ECN or ECP processes as described in Kodak Publication No. H-24, Manual For Processing Eastman Color Films. Where applicable, the element may be processed in accordance with the Kodak Ektaprint 2 Process as described in Kodak Publication No. Z-122, using Kodak Ektaprint chemicals. To provide a positive (or reversal) image, the color development step can be preceded by development with a non-chromogenic developing agent to develop exposed silver halide, but not form dye, and followed by uniformly fogging the element to render unexposed silver halide developable. For elements that lack incorporated dye image formers, sequential reversal color development with developers containing dye image formers such as color couplers is illustrated by the Kodachrome K-14 process (see U.S. Pat. Nos. 2,252,718; 2,950,970; and 3,547,650). For elements that contain incorporated color couplers, the E-6 color reversal process is described in the *British Journal of Photography Annual* of 1977, pages 194–197.

The invention will be further illustrated by the following examples in which parts and percentages are given by weight unless otherwise specified.

EXAMPLE 1

A dispersion of filter dye D-1 was prepared by combining 375 g of D-1 with 93.75 g poly(vinyl pyrrolidone) and 1031 g methanol. The slurry was milled in an Eiger media mill containing 213 ml of 1.0 mm zirconium silicate beads by circulating it through the milling chamber for 17 hours. After milling, the slurry was diluted to a concentration of 10% dye by adding 2250 g methanol. The nonaqueous slurry contained well dispersed solid dye particles less than 1 micron in size.

EXAMPLE 2

A dispersion of dye D-6 was prepared by placing 3.0 g of dye D-6 in a 125 ml glass jar containing 6.0 g of a 10% solution of dispersant Solsperse 24000 (Zeneca, Inc.) in ethyl acetate, 21.0 g ethyl acetate and 60 ml of 1.8 mm zirconium oxide beads. The jar was rolled at a speed of 19.8 m/min for 3 days. After milling, the dispersion was diluted to a concentration of 5% dye with ethyl acetate, and separated from the milling beads. This dispersion was called dispersion A. A second dispersion, called dispersion B, was made in the same manner as A except the dispersant used was a 10% solution of Triton X-200 and the liquid was 21.0 g of distilled water. After milling, the dispersion was diluted to a concentration of 5% dye with water, and separated from the milling beads. The stability to flocculation of each dispersion was evaluated. Results are given in Table 1.

TABLE 1

Dispersions of Dye D-6

| Dispersion ID # | Observations After Milling |
|---|---|
| A (nonaqueous invention) | nonviscous, nonflocculated |
| B (aqueous control) | viscous, flocculated |

Results from Table 1 show that the nonaqueous dispersions of filter dye D-6 prepared in accordance with the invention are more stable to viscosity build-up and flocculation compared to the control dispersion prepared with water.

EXAMPLE 3

In this example, a nonaqueous solid particle dye dispersion of dye D-13 was used to prepare a backing layer of a photographic support containing the dye dispersion for antihalation protection, a lubricant, an antistat, and an abrasion resistant binder.

A crystalline solid particle dispersion of filter dye D-13 was prepared by placing 35 g of dye D-13 in a 2500 ml glass jar containing 530.5 g methanol, 17.5 g of a 10% methanol solution of dispersant Hypermer PS-2 made by ICI Americas, Inc. and 1250 ml of 1.8 mm zirconium oxide beads. The jar was rolled at a speed of 28.6 m/min for 10 days. After this time period, the dye slurry as diluted to 5% dye with additional methanol, and separated from the milling beads. The final slurry contained well-dispersed dye particles, less than 1 micron in size, called Dispersion C.

A coating melt was prepared which contained filter dye from Dispersion C, a polymeric binder of ethyl acrylate, acrylic acid and N,N-dimethyl acrylamide in a weight ratio of 2:1:1, as a 25% solids solution in a 1:1 mixture of methanol and acetone, and carnauba wax in the form of a 17.5% solids dispersion of type 1 carnauba wax in isopropanol, supplied by the Daniel Products Company as SLIP-AYD SL508. The final melt concentration was 3% solids, 95.06% methanol and 1.94% acetone. The dye dispersion, binder solution and wax dispersion were combined such that the percentages of the dye, binder and wax relative to the total weight of solids were 40%, 54% and 6%, respectively. The coating melt was applied from a fixed-slot hopper having a gap width of 0.127 mm onto a cellulose triacetate support previously coated with an antistat layer comprising cellulose nitrate binder and vanadium pentoxide at a weight ratio of 2:1 and a dry coverage 32 mg/m$^2$, and a barrier layer comprising cellulose diacetate and cellulose nitrate at a weight ratio of 3:1 and a dry coverage of 215 mg/m$^2$. The coating diagram is shown below. In the manufacture of a photosensitive photographic element, the opposite side of the support may be coated conventionally with a subbing layer and aqueous coated photosensitive silver halide emulsion layers.

| Abrasion Resistant Backing with Dye from Dispersion C and Lubricant |
|---|
| Barrier Layer |
| Antistat Layer |
| Support |

A filter dye backing layer coating was prepared from the above described coating formulation. The coating was tested for coefficient of friction (ASTM Method # D1894, using an IMASS Instruments of Massachusetts flat bed tester and a carbide ball supported sled, at 21° C., 50% RH, and a test speed of 198 cm/min for 35 mm by 5 cm test strips), scratch resistance (ASTM Single Arm Scratch test) and orthochromatic optical density. The coating was also processed in a commercially available motion picture photographic color print process which included processing in an alkaline aqueous solution at pH of above 8, to determine the amount of dye removed or decolorized after photographic processing. The color print process was the Eastman Color Print ECP-2B development process, commercially available from Eastman Kodak Co., USA. The ECP-2B process is described in, e.g., "Manual for Processing Eastman Color Film—H-24", available from Eastman Kodak Company, Rochester, N.Y.

A preferred range for coefficient of friction is 0.1–0.3. The single-arm scratch resistance values preferably exceed 180, more preferably exceed 220, and most preferably exceed 250. Optical density preferably should be greater than 0.5, more preferably greater than 0.8, and most preferably greater than 1.0 before processing and less than 0.1 after processing. The physical properties of the coating are given in Table 2. From Table 2 is shown that this coating gave acceptable lubricity, abrasion resistance and optical density for antihalation protection, and the dye is fully removed upon photographic processing.

TABLE 2

Coatings from dispersion C and Example 3 Coating Formulation.

| Dry Coverage mg/m$^2$ | Coefficient of Friction | Scratch Resistance | Pre-process Optical Density | Post-process Optical Density |
|---|---|---|---|---|
| 646 | 0.26 | 230 | 1.44 | 0.07 |

Further experiments were conducted wherein the dye, binder, and lubricant percentages, and dry coverages were varied. Such experiments demonstrated that the friction, scratch resistance and density values could each be further optimized within desired ranges in accordance with increasing or decreasing the percentages and absolute coverages of such compounds.

EXAMPLE 4

A crystalline solid particle dispersion of dye D-1 was prepared by placing 18.0 g of Dye D-1 in a 500 ml glass jar containing 70.0 g ethyl acetate, 36.0 g of a 10% solution of dispersant Solsperse 24000 (Zeneca, Inc.) in ethyl acetate and 250 ml of 1.8 mm zirconium oxide beads. The jar was rolled at a speed of 23.8 m/min for 3 days. After this time period, the dye slurry was diluted to 7% dye with additional ethyl acetate, and separated from the milling beads. The final slurry contained well-dispersed dye particles, less than 1 micron in size, called dispersion D. Dispersions of dyes D-2 through D-6, D-10 and D-11 were prepared by placing 3.0 g of each dye in a 125 ml glass jar containing 6.0 g of a 10% solution of dispersant Solsperse 24000 (Zeneca, inc.) in ethyl acetate, 21.0 g ethyl acetate and 60 ml of 1.8 mm zirconium oxide beads. The jars were rolled at a speed of 19.8 m/min for 3 days. The final slurries contained dye particles with an average size of less than 1 micron, called dispersions E through K. Dispersions of dyes D-13 through D-16 were prepared by placing 2.5 g of each dye in a 250 ml glass jar containing 5 g of a 10% solution of surfactant Aerosol OT in ethyl acetate, 42.5 g ethyl acetate and 125 ml of 1.8 mm zirconium oxide beads. The jars were rolled at a speed of 21.3 m/min for days. The final slurries contained dye particles with an average size of less than 1 micron, called dispersions L through O.

The following coating melts were prepared by combining Dispersions D through O with a 10% ethyl acetate solution of polymethyl methacrylate (PMMA) and ethyl acetate in the concentrations given in Table 3.

TABLE 3

Coating melts prepared from dispersions D through O.

| Coating No. | Dye ID | Dispersion ID | Dispersion, g | 10% PMMA, g | ethyl acetate, g | total melt, g |
|---|---|---|---|---|---|---|
| 1 | D1 | D | 71.4 | 50 | 78.6 | 200 |
| 2 | D2 | E | 50 | 25 | 25 | 100 |
| 3 | D3 | F | 45.3 | 25 | 29.7 | 100 |
| 4 | D4 | G | 50 | 25 | 25 | 100 |
| 5 | D5 | H | 48.2 | 25 | 26.8 | 100 |
| 6 | D6 | I | 50 | 25 | 25 | 100 |
| 7 | D10 | J | 50 | 25 | 25 | 100 |
| 8 | D11 | K | 50 | 25 | 25 | 100 |
| 9 | D13 | L | 27 | 13.5 | 13.5 | 54 |
| 10 | D14 | M | 34 | 17 | 17 | 68 |
| 11 | D15 | N | 36 | 18 | 18 | 72 |
| 12 | D16 | O | 31 | 15.5 | 15.5 | 62 |

The melts were coated at a dry coverage of 161 mg/m$^2$ dye and 323 mg/m$^2$ PMMA on polyester support with a gelatin sub. FIGS. 1–12 show the absorbance spectra for coatings 1–12, respectively. In general, the non-aqueous solid particle dispersions exhibit functional absorbance spectra, which may be advantageously used to filter light either selectively or in combination completely across the visible spectrum. The pentamethine oxonol-type barbituric acid dyes of FIGS. 5, 10, 11, and 12 exhibit particularly wide absorbance spectra in the form of non-aqueous solid particle dispersions, which is particularly advantageous for providing effective antihalation protection either alone or in combination with additional dyes.

Coatings 1–12 were processed in commercially available motion picture photographic color negative and color print processes, each of which included processing in alkaline aqueous solutions at pH of above 8, to determine the amount of dye removed or decolorized after processing. The color negative process was the Eastman Color Negative ECN-2 development process, and the color print process was the Eastman Color Print ECP-2B development process, both commercially available from Eastman Kodak Co., USA. The ECN-2 and ECP-2B processes and the compositions for such processes are described in, e.g., "Manual for Processing Eastman Color Film—H-24", available from Eastman Kodak Company, Rochester, N.Y. A post-process optical density less than 0.1 is desirable. To evaluate the incubation stability of the dyes, coatings 1–12 were also held for 1 week at 49° C. and 50% relative humidity, then the absorbance spectra were read without processing. These results are shown in Table 4. From Table 4 it is shown that coatings containing the nonaqueous solid particle dispersions exhibit good incubation stability and are removed or decolorized upon photographic processing.

TABLE 4

Maximum optical densities (D-max) for coatings 1–12.

| Coating No. | Dye No. | D-max Pre-Process | Dmax after incubation+ Pre-Process | D-max Post-Process Color Negative | D-max Post-Process Color Print |
|---|---|---|---|---|---|
| 1 | D1 | 0.997 | 1.164 | 0.010 | 0.010 |
| 2 | D2 | 0.663 | 0.650 | 0.083 | 0.013 |
| 3 | D3 | 0.220 | 0.231 | 0.010 | 0.010 |
| 4 | D4 | 1.170 | 1.161 | 0.010 | 0.010 |
| 5 | D5 | 0.308 | 0.273 | 0.010 | 0.010 |
| 6 | D6 | 1.442 | 1.418 | 0.016 | 0.018 |

TABLE 4-continued

Maximum optical densities (D-max) for coatings 1–12.

| Coating No. | Dye No. | D-max Pre-Process | Dmax after incubation+ Pre-Process | D-max Post-Process Color Negative | D-max Post-Process Color Print |
|---|---|---|---|---|---|
| 7 | D10 | 0.757 | 0.646 | 0.060 | 0.055 |
| 8 | D11 | 0.368 | 0.360 | 0.010 | 0.010 |
| 9 | D13 | 0.982 | 1.041 | 0.010 | 0.00 |
| 10 | D14 | 0.503 | 0.576 | 0.010 | 0.010 |
| 11 | D15 | 0.450 | 0.390 | 0.010 | 0.010 |
| 12 | D16 | 0.587 | 0.588 | 0.010 | 0.010 |

+1 week at 49° C. and 50% relative humidity

EXAMPLE 5

A dispersion of filter dye D-7 was prepared by placing 228 g of dye D-7 in a 4 liter glass jar containing 57 g of poly(vinyl pyrrolidone), 475 g of methanol and 1900 ml of 1.8 mm zirconium oxide beads. The jar was rolled at a speed of 31.4 m/min for 7 days. After milling, the slurry was diluted to a concentration of 5% dye by adding 3800 g methanol. A second dispersion of filter dye D-7 was prepared in the same manner, except 57 g of dispersant Solsperse 24000 (Zeneca, Inc.) was used in place of poly(vinyl pyrrolidone), and 475 g of n-propyl acetate was used in place of methanol. After milling, the slurry was diluted to a concentration of 5% dye by adding 3800 g n-propyl acetate. Both dispersions contained well dispersed particles less than 1 micron in size.

Figure 13:
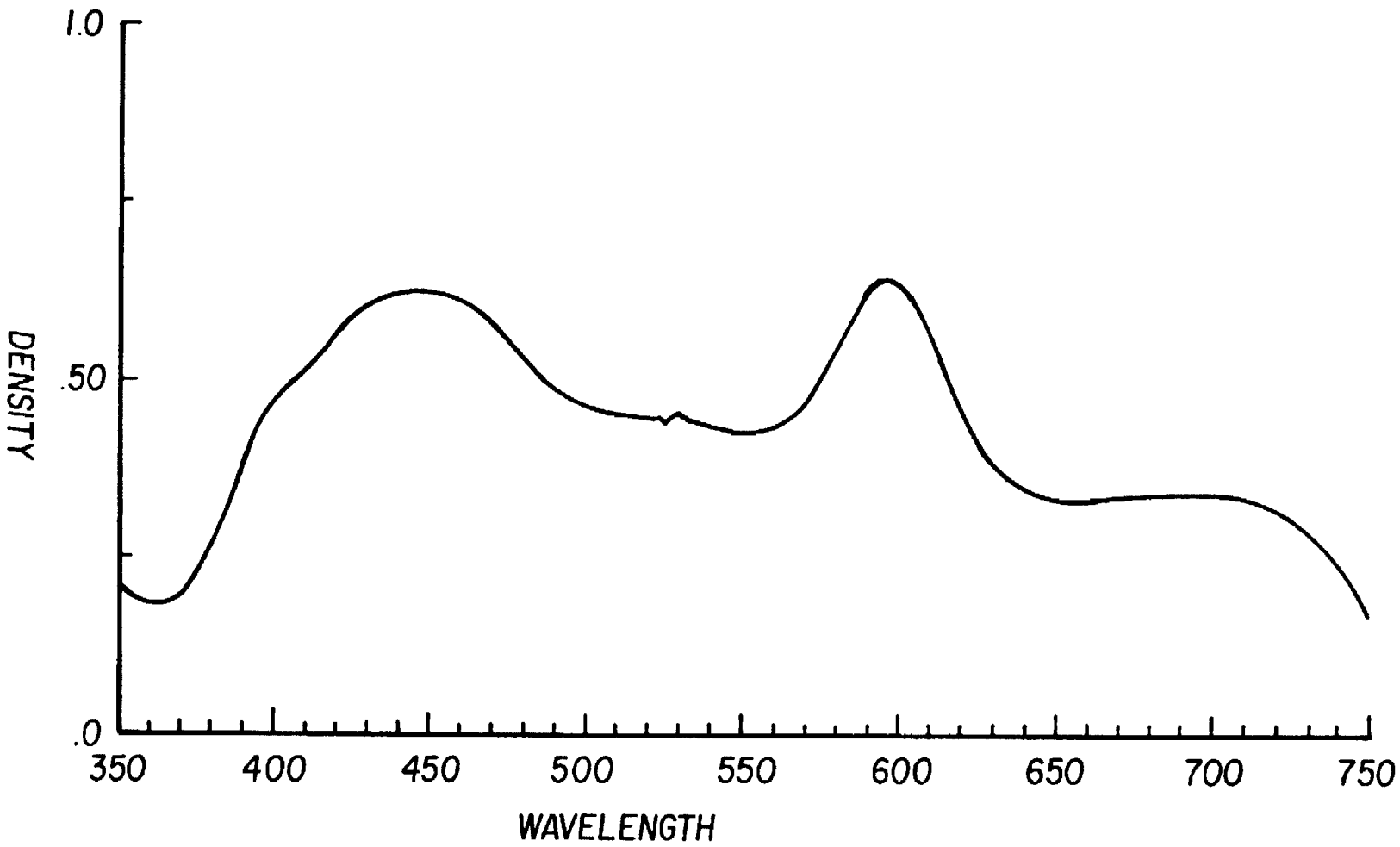

A coating melt was prepared which contained filter dye D-1 from the dispersion in Example 1, filter dye D-7 from the above methanol dispersion, a polymeric binder of ethyl acrylate, acrylic acid and N,N-dimethyl acrylamide in a weight ratio of 2:1:1, as a 25% solids solution in a 1:1 mixture of methanol and acetone, and additional acetone and methanol to form the balance of the liquid in the melt. The final melt concentration was 3% solids, 43.65% acetone and 53.35% methanol. The dye dispersion and binder solution were combined such that the weight ratios of dye D-1, dye D-7 and binder were 1:1:2 respectively. The coating melt was applied onto a cellulose triacetate support from a fixed-slot hopper having a gap width of 0.127 mm. The resulting dry coverages of dye D-1, dye D-7 and binder were 108 mg/m$^2$, 108 mg/m$^2$, and 215 mg/m$^2$ respectively. The absorbance spectra for this coating is shown in FIG. 13. The combination of non-aqueous solid particle filter dye dispersions provides substantial absorbance throughout the visible light spectrum, which is especially advantageous in providing antihalation protection in photographic elements.

EXAMPLE 6

A color photographic negative working element was prepared as follows:

A cellulose triacetate support was coated on one side thereof with an antistat layer comprising a 3:1:1 weight ratio of zinc antimonate, cellulose diacetate and ultraviolet light absorbing compound UVINUL 3050 at a dry coverage of 323 mg/m$^2$ from a solution containing equal amounts of acetone and methanol. The antistat layer was then overcoated with a layer comprising filter dye D-1 from the dispersion in Example 1, filter dye D-7 from the methanol dispersion of Example 5, a polymeric binder of ethyl acrylate, acrylic acid and N,N-dimethyl acrylamide in a weight ratio of 2:1:1, carnauba wax in the form of a 17.5% solids dispersion in isopropanol, and acetone and methanol to form the balance of liquid in the melt. The final melt contained 3% solids, 38.8% acetone and 58.2% methanol. The dye dispersions, binder and wax were combined such that the weight ration of the dye D-1, the dye D-7, binder and wax was 3:3:3:1 respectively. The coating melt was applied over the antistat layer from a fixed-slot hopper having a gap width of 0.127 mm. The resulting dry coverages of dye D-1, dye D-7, binder and wax were 192 mg/m$^2$, 192 mg/m$^2$, 192 mg/m$^2$ and 64 mg/m$^2$ respectively.

The opposite side of the support was coated with a gelatine subbing layer onto which aqueous coated slow, mid and fast red sensitive, cyan dye forming emulsion layers, slow, mid and fast green sensitive, magenta dye forming emulsion layers, slow, mid and fast blue sensitive, yellow dye forming emulsion layers, various interlayers and an overcoat layer substantially as described in Example 2 of U.S. Pat. No. 5,283,164, the disclosure of which is incorporated by reference.

The film was exposed and subsequently processed in a ECN-2 development process. The non-aqueous coated dispersions of solid particle filter dyes D-1 and D-7 were found to be fully removed after processing.

The invention has been described in detail with particular reference to preferred embodiments thereof, but it will be understood that variations and modifications can be effected within the spirit and scope of the invention.

We claim:

1. A process for forming a photographic element comprising (a) coating a first layer on a transparent support from a coating composition comprising an organic solvent, an alkaline aqueous insoluble, organic solvent soluble film forming binder, and a solid particle non-aqueous dispersion of a filter dye which is substantially insoluble in the organic solvent and readily soluble or decolorizable in alkaline aqueous photographic processing solutions at pH of 8 or above, and (b) coating a second layer on the opposite side of the support relative to the filter dye containing layer from an aqueous coating composition comprising a silver halide emulsion.

2. The process of claim 1, wherein the film forming binder comprises a polymer comprising 40–100 weight percent of ethyl acrylate, methyl acrylate, propyl acrylate, ethyl methacrylate, propyl methacrylate, or butyl methacrylate units, 0–30 weight percent of acrylic acid, methacrylic acid, or itaconic acid units, and 0–30 weight percent of N,N-dimethyl acrylamide, i-propyl acrylamide, t-butyl acrylamide, i-propyl methacrylamide, or t-butyl methacrylamide units.

3. The process of claim 2, wherein the film forming binder comprises a polymer comprising about 50 weight percent ethyl acrylate units, about 25 weight percent acrylic acid units, and about 25 weight percent N,N-dimethyl acrylamide units.

4. The process of claim 1, wherein the film forming binder comprises an acrylic ester homopolymer.

5. The process of claim 1, wherein the solid particle nonaqueous filter dye dispersion comprises at least 5 weight % dye.

6. The process of claim 1, further comprising coating antistatic agents in at least one photographic process surviving layer on the same side of the support as the filter dye, which process surviving layer may be either the same layer as the filter dye or an additional layer, such that the film support also has antistatic protection retained after photographic processing.

7. The process of claim 1, further comprising coating lubricating agents in at least one photographic process surviving layer on the same side of the support as the filter dye, which process surviving layer may be either the same layer as the filter dye containing layer or an additional layer, such that the film support also has friction protection retained after photographic processing.

8. The process of claim 7, wherein antistatic agents are coated in a layer between the support and the filter dye containing layer, and the lubricating agents are coated in the filter dye containing layer.

9. The process of claim 1, wherein the solid particle non-aqueous filter dye dispersion comprises a dye of the formula (I) dispersed in a non-aqueous liquid:

$$D—(X)_n \qquad (I)$$

where D represents a residue of a compound having a chromophoric group which is substantially insoluble in the non-aqueous liquid, X represents a group having an ionizable proton bonded to D either directly or through a bivalent bonding group, and n is 1–7.

10. The process of claim 9, wherein D represents an oxonol, merocyanine, cyanine, arylidene, azomethine, triphenylmethane, azo, or anthraquinone dye residue.

11. The process of claim 9, wherein X represents a carboxyl group, a sulfonamido group, a sulfamoyl group, a sulfonylcarbamoyl group, a carbonylsulfamoyl group, a hydroxy group, or the enol group of a oxanol dye.

12. The process of claim 9, wherein the filter dye is of the formula (II):

$$[D—(A)_y]—X_n \qquad (II)$$

wherein A is an aromatic ring bonded directly or indirectly to D, y is 0 to 4, and X is bonded either on A or an aromatic ring portion of D.

13. The process of claim 9, wherein D represents a pentamethine oxonol-type barbituric acid dye residue.

14. The process of claim 9, wherein the non-aqueous liquid comprises at least 90% by weight ethyl acetate, propyl acetate, methanol, ethanol, butanol, n-propanol, methyl acetoacetate, acetone, or combinations thereof.

15. The process of claim 9, wherein the filter dye is

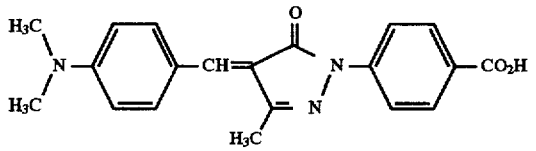

Dye D-1

-continued
Dye D-2
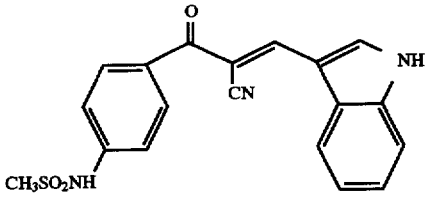
Dye D-3
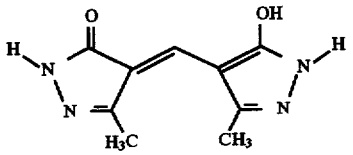
Dye D-4
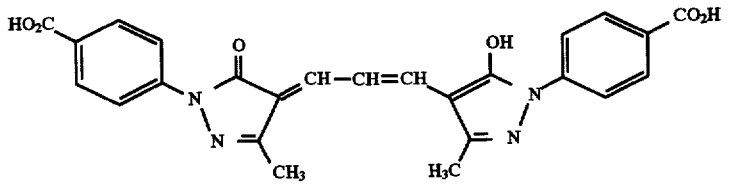
Dye D-5
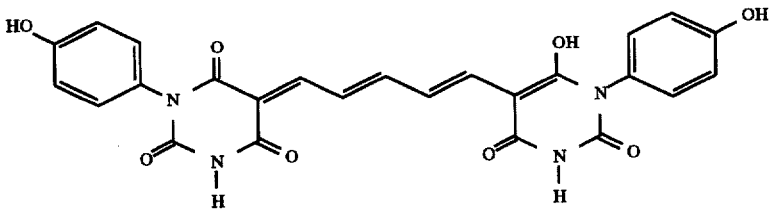
Dye D-6
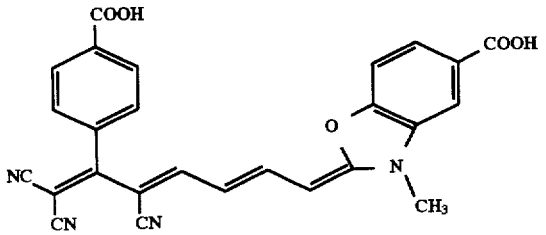
Dye D-7
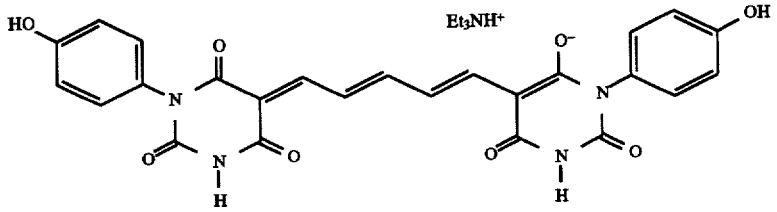
Dye D-8
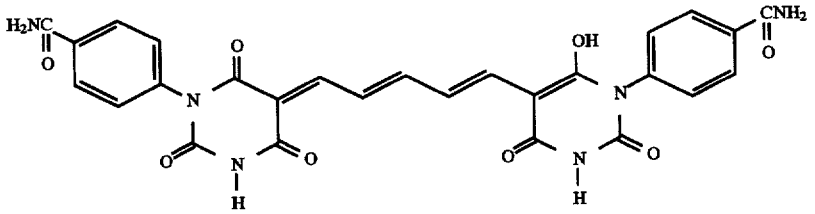
Dye D-9
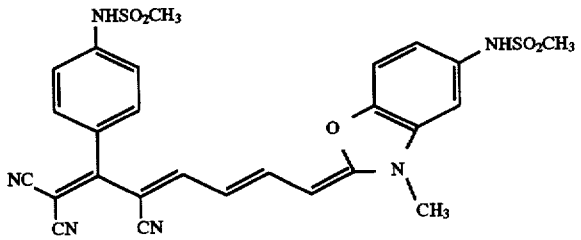

-continued
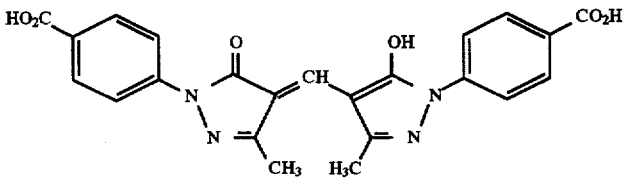
Dye D-10
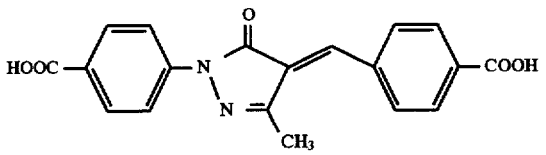
Dye D-11
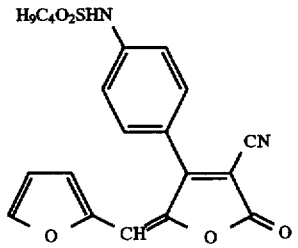
Dye D-12
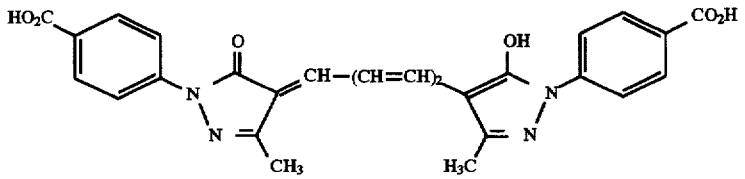
Dye D-13
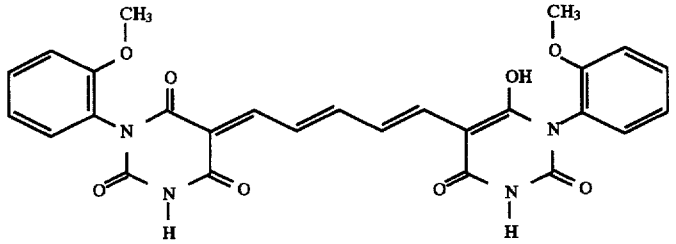
Dye D-14
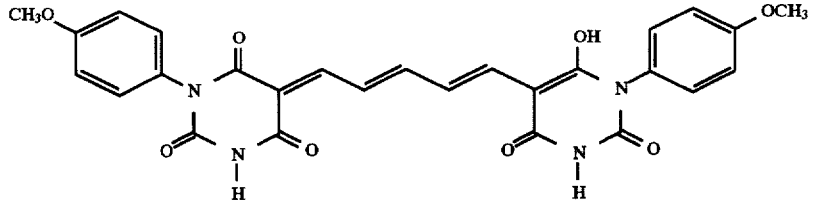
Dye D-15
or
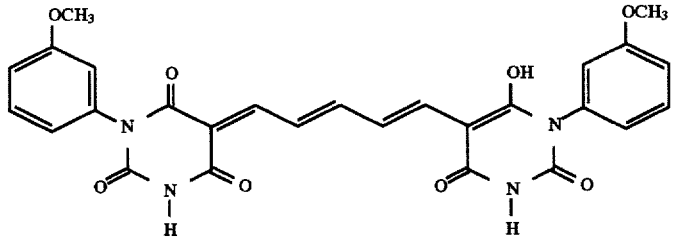
Dye D-16
16. The process of claim 15, wherein the filter dye is

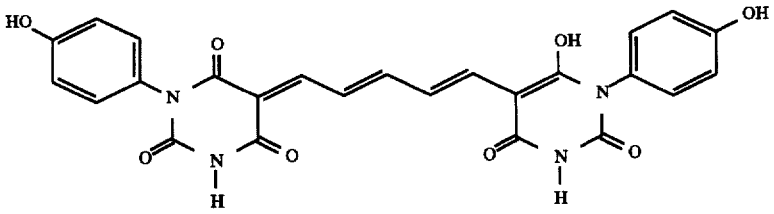

Dye D-5

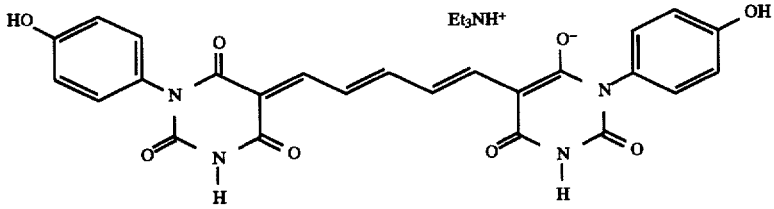

Dye D-7

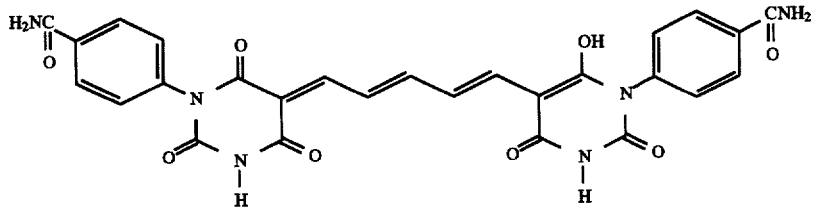

Dye D-8

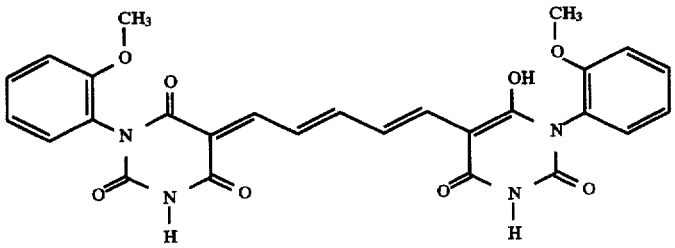

Dye D-14

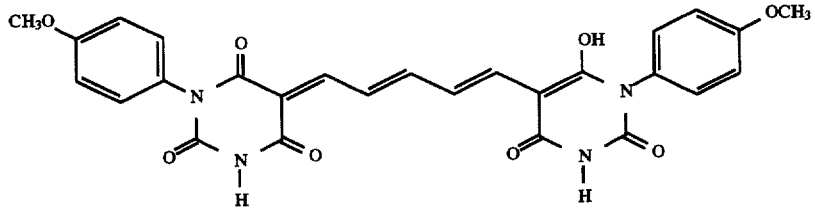

Dye D-15 or

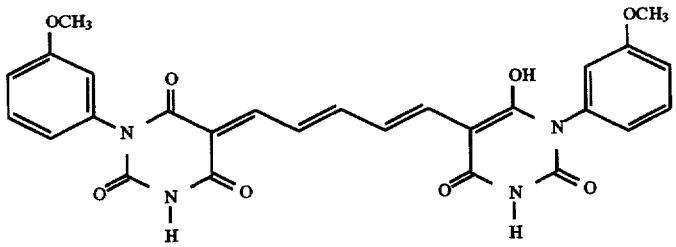

Dye D-16

17. A photographic element comprising an organic solvent coated first layer on one side of a transparent support, said first layer comprising a non-aqueous solid particle dispersion of a filter dye which is readily soluble or decolorizable in alkali aqueous photographic processing solutions at pH of 8 or above dispersed in an alkaline aqueous insoluble, organic solvent soluble film forming binder, and an aqueous coated second layer comprising a silver halide emulsion on the opposite side of the support relative to the filter dye containing layer.

18. The element of claim 17, wherein the filter dye containing second layer further comprises lubricating agents, and further comprising a layer comprising antistatic agents coated between the support and the filter dye containing layer, such that the film support also has antistatic and friction protection retained after photographic processing.

19. The element of claim 17, wherein the filter dye comprises a dye of the formula (I):

$$D-(X)_n \qquad (I)$$

where D represents a residue of a compound having a chromophoric group, X represents a group having an ionizable proton bonded to D either directly or through a bivalent bonding group, and n is 1–7.

20. The element of claim 17, wherein D represents an oxonol, merocyanine, cyanine, arylidene, azomethine, triphenylmethane, azo, or anthraquinone dye residue, and X represents a carboxyl group, a sulfonamido group, a sulfamoyl group, a sulfonylcarbamoyl group, a carbonylsulfamoyl group, a hydroxy group, or the enol group of a oxanol dye.

21. The element of claim 17, wherein D represents a pentamethine oxonol-type barbituric acid dye residue.

22. The element of claim 17, wherein the film forming binder comprises a polymer comprising 40–100 weight percent of ethyl acrylate, methyl acrylate, propyl acrylate, ethyl methacrylate, propyl methacrylate, or butyl methacrylate units, 0–30 weight percent of acrylic acid, methacrylic acid, or itaconic acid units, and 0–30 weight percent of N,N-dimethyl acrylamide, i-propyl acrylamide, t-butyl acrylamide, i-propyl methacrylamide, or t-butyl methacrylamide units.

23. The element of claim 22, wherein the film forming binder comprises a polymer comprising about 50 weight percent ethyl acrylate units, about 25 weight percent acrylic acid units, and about 25 weight percent N,N-dimethyl acrylamide units.

24. The element of claim 17, wherein the film forming binder comprises an acrylic ester homopolymer.

* * * * *